US007845749B2

(12) United States Patent
Kuwahara et al.

(10) Patent No.: US 7,845,749 B2
(45) Date of Patent: Dec. 7, 2010

(54) LIQUID-EJECTING METHOD AND LIQUID-EJECTING APPARATUS

(75) Inventors: Soichi Kuwahara, Kanagawa (JP); Minoru Kohno, Tokyo (JP); Masato Nakamura, Kanagawa (JP)

(73) Assignee: Sony Corporation, Tokyo (JP)

( * ) Notice: Subject to any disclaimer, the term of this patent is extended or adjusted under 35 U.S.C. 154(b) by 1665 days.

(21) Appl. No.: 10/702,661

(22) Filed: Nov. 7, 2003

(65) Prior Publication Data

US 2004/0125172 A1 Jul. 1, 2004

(30) Foreign Application Priority Data

Nov. 13, 2002 (JP) ..... P2002-329853
Nov. 29, 2002 (JP) ..... P2002-348147

(51) Int. Cl.
*B41J 2/205* (2006.01)

(52) U.S. Cl. ..... 347/15

(58) Field of Classification Search ..... 347/15
See application file for complete search history.

(56) References Cited

U.S. PATENT DOCUMENTS

| | | | | |
|---|---|---|---|---|
| 5,172,139 | A | 12/1992 | Sekiya et al. | |
| 5,510,816 | A * | 4/1996 | Hosono et al. | 347/10 |
| 5,541,628 | A * | 7/1996 | Chang et al. | 347/10 |
| 6,022,092 | A | 2/2000 | Misumi | |
| 6,227,639 | B1 | 5/2001 | Sekiya et al. | |
| 6,318,847 | B1 | 11/2001 | Wade | |

FOREIGN PATENT DOCUMENTS

| | | | |
|---|---|---|---|
| EP | 0 636 482 | B1 | 7/1994 |
| EP | 0 636 482 | A2 | 2/1995 |
| EP | 0 913 256 | A2 | 10/1998 |
| EP | 0 913 256 | A | 5/1999 |
| EP | 0 913 256 | A2 | 5/1999 |
| EP | 1 016 527 | A | 7/2000 |
| EP | 1 157 844 | A1 | 12/2000 |
| EP | 1 157 844 | A | 11/2001 |
| EP | 1 157 844 | A1 * | 11/2001 |
| EP | 1 354 704 | A | 10/2003 |
| EP | 1 354 704 | A1 | 10/2003 |

OTHER PUBLICATIONS

European Search Report dated Mar. 24, 2004.
European Search Report dated Jul. 1, 2004.
Australian Search Report.
Australian Supplementary Search Report Aug. 5, 2005.
European Search Report dated Feb. 12, 2008 for corresponding European Application No. 07119490.6-2304.

* cited by examiner

*Primary Examiner*—Stephen D Meier
*Assistant Examiner*—Geoffrey Mruk
(74) *Attorney, Agent, or Firm*—Rader, Fishman & Grauer PLLC

(57) ABSTRACT

In a liquid-ejecting method for ejecting liquid contained in a liquid chamber from a nozzle as a liquid droplet group, the ejection amount of each liquid droplet of the continuously ejected liquid-droplet group can be stabilized corresponding to a wide frequency band of a pulse signal. Also, when one pixel is formed with a plurality of liquid droplets using a head capable of deflecting the ejecting direction of the liquid droplet, the image quality is improved by reducing the landing positional displacement between plural liquid droplets for forming the one pixel.

3 Claims, 20 Drawing Sheets

LIQUID-EJECTING METHOD AND LIQUID-EJECTING APPARATUS

In a liquid-ejecting method for ejecting liquid contained in a liquid chamber from a nozzle as a liquid droplet group, the ejection amount of each liquid droplet of the continuously ejected liquid-droplet group can be stabilized corresponding to a wide frequency band of a pulse signal. Also, when one pixel is formed with a plurality of liquid droplets using a head capable of deflecting the ejecting direction of the liquid droplet, the image quality is improved by reducing the landing positional displacement between plural liquid droplets for forming the one pixel.

BACKGROUND OF THE INVENTION

1. Field of the Invention

The present invention relates to a liquid-ejecting apparatus having a head with a plurality of liquid-ejecting units, each unit having a nozzle, and a liquid-ejecting method.

2. Description of the Related Art

As an example of a liquid-ejecting apparatus having a head with a plurality of liquid-ejecting units, each unit having a nozzle, an inkjet-type recording apparatus has been known. The inkjet-type recording apparatus such as an inkjet printer has been widely used in view of high-speed recording, inexpensive running cost, and easy colorizing, so that techniques for forming high-resolution and high-quality printed images have been developed.

For example, there is a serial-type print head in which while a print head is reciprocated in the full-width direction of a recording medium, ink is ejected from a liquid-ejecting unit arranged in the print head so as to form printed images. In the serial-type print head, a multipath system is employed. The multipath is a system in which when ink is ejected so as to form printed images during the reciprocation of the print head, for one line constituting printed images, ink is ejected from a plurality of liquid-ejecting units. Thereby, fluctuations in an ejecting direction and an ejection amount of ink ejected from each liquid-ejecting unit are able to be inconspicuous.

Also, in the inkjet printer, a pulse number modulation (a method for forming one pixel by a plurality of ink droplets so-called PNM) has been known. FIG. 20 is an explanatory view illustrating the pulse number modulation (PNM system). In this method, within one pixel region, ink droplets are continuously ejected plural times. It is not until the ink droplet landed at first is absorbed (permeated) into a photographic sheet that the next ink droplet is landed so that at least part of a region is overlapped with another region. FIG. 20 shows examples from an example where an ink droplet is landed once up to an example where ink droplets are landed five times. It is not until the ink droplet landed at first is absorbed (permeated) into a photographic sheet that the next ink droplet is landed, so that a plurality of ink droplets are united so as to form one large pixel. That is, the PNM is a system in which by adjusting the number of ink droplets ejected from each liquid-ejecting unit, the diameter of a pixel constituting a printed image is variably controlled so as to express gradation. In order to form high-quality printed images using such a PNM system, it is an important object to stabilize the ejection amount of an ink droplet ejected from each liquid-ejecting unit. As a technique relating to such an object, it is disclosed that during continuously ejecting ink, the amount of an ink droplet is stabled (Japanese Patent Publication No. 3157945 (page 3, FIGS. 5 and 8) for example).

The technique described in Japanese Patent Publication No. 3157945 relates to a technique in that a plurality of independent ink droplets for one pixel are defined as a ink droplet group and a pulse interval is set for a pulse signal for ejection from the same ejecting unit. Specifically, in a frequency band in which with increasing the pulse interval, the ejection amount per one droplet increases, the pulse interval is established so that the amount of each ink droplet of the ink droplet group is equalized with the amount of an ink droplet when a single ink droplet is ejected. Thereby, the pulse interval for equalizing the amount of each ink droplet of the ink droplet group ejected continuously is selected from a graph between a drive frequency and ink ejection amount characteristics, and the amount of each ink droplet can be constant using the selected pulse interval. However, this pulse interval is uniquely determined, so that it has not been arbitrarily established.

Incidentally, in response to the serial-type print head, there is a line-type print head having a number of head chips arranged corresponding to the entire width of a recording medium. If the line-type print head is applied to the technique described in Japanese Patent Publication No. 3157945, along with increase in the number of liquid-ejecting units, the electric power applied to a heating element provided in each liquid-ejecting unit may concentrate. In this case, the voltage of a power supply for supplying electric power to each heating element fluctuates, and as a result, high-quality images may not be formed (a first problem).

Also, in the technique described in Japanese Patent Publication No. 3157945, even if the pulse interval for equalizing the amount of each ink droplet of the ink droplet group ejected from each liquid-ejecting unit is selected from the graph about the ink ejection amount characteristics, by the effect of fluctuations of each component in the manufacturing process of the print head or changes in temperature in use, the amount of each ink droplet is liable to change, So that it has been difficult to stabilize the amount of each ink droplet of the ink droplet group ejected from each liquid-ejecting unit (a second problem).

Since in the line-type print head, a recording medium is moved relatively to the print head only in a direction perpendicular to the longitudinal direction of the print head so as to form printed images, the multipath system cannot be applied thereto. Therefore, fluctuations of each liquid-ejecting unit in the ejecting direction get lined-up along the imaging direction. If a head with fluctuations in the ejecting direction is used, although the printing must be actually performed as shown in FIG. 19B, there has been a problem of printed images with streaks and unevenness as shown in FIG. 19A (a third problem).

On the other hand, while the third problem being solved, in a liquid-ejecting apparatus having a head (line head) with a plurality of liquid-ejecting units arranged thereon, a technique enabling the PNM system, in which while liquid ejecting direction is controlled (deflected), one pixel is formed by landing ink droplets on one pixel region using a plurality of liquid-ejecting units, to be employed thereinto is proposed in Japanese Patent Application 2002-161928, which is assigned to the same assignee as this application.

However, in forming one pixel by landing ink droplets using a plurality of liquid-ejecting units, since a plurality of the liquid-ejecting units correspond to the one pixel, signal processing for ejection execution is complicated.

Furthermore, in forming one pixel by a plurality of ink droplets ejected from a plurality of liquid-ejecting units, as shown in FIG. 21, the displacement in landing positions of the ink droplets ejected from each liquid-ejecting unit tends to increase. Therefore, as shown in FIG. 21, when dots formed by a plurality of the ink droplets are united so as to form one pixel, the shape of the pixel is not approximated to a circle, and this may result in image-quality deterioration (a fourth problem).

SUMMARY OF THE INVENTION

Accordingly, in order to solve the first and second problems, it is an object of the present invention to provide a liquid-ejecting apparatus and a liquid-ejecting method capable of stabilizing the ejection amount of each liquid droplet of a liquid-droplet group continuously ejected toward one landing point from a nozzle of a liquid-ejecting apparatus having a head with a plurality of liquid-ejecting units, each unit having the nozzle, corresponding to a wide frequency band of a pulse signal (a first object).

Furthermore, in order to solve the third and fourth problems, it is another object of the present invention to improve image quality by reducing displacement in landing positions between a plurality of liquid droplets for forming one dot so as to improve the dot quality when the one dot is formed from a plurality of the liquid droplet using a head capable of deflecting the ejecting direction of liquid droplets (a second object).

Accordingly, the present invention solves the objects described above by the following solving means.

In order to achieve the first object, a liquid-ejecting method according to the present invention comprises the steps of replenishing a liquid chamber, which is formed corresponding to a nozzle for ejecting liquid therefrom, with liquid; and ejecting liquid contained in the liquid chamber as continuous liquid-droplet groups from the nozzle by feeding a pulse signal to ejecting-energy generating means disposed within the liquid chamber, wherein the ejection amount of each liquid droplet of the liquid-droplet group continuously ejected from the nozzle toward one landing point by the pulse signals is fixed or approximated at constant corresponding to a predetermined frequency band of the pulse signal, and liquid is ejected by variably controlling a drive frequency of the pulse signal within the frequency band.

By such a method, the ejection amount of each liquid droplet of the liquid-droplet group continuously ejected from the liquid-ejecting hole toward one landing point by the pulse signals generated by the pulse-signal generating means is fixed or approximated at constant corresponding to a predetermined frequency band of the pulse signal, and liquid is ejected by variably controlling a drive frequency of the pulse signal within the frequency band, so that the ejection amount of each liquid droplet of the continuously ejected liquid-droplet group can be stabilized corresponding to a predetermined frequency band of the pulse signal.

In order to achieve the first object, a liquid-ejecting apparatus according to the present invention comprises a nozzle member having a nozzle for ejecting liquid therefrom; a liquid chamber formed corresponding to the nozzle; ejecting-energy generating means disposed within the liquid chamber for generating energy for ejecting liquid contained in the liquid chamber from the nozzle as a liquid-droplet group; and pulse-signal generating means for generating a pulse signal for feeding it to the ejecting-energy generating means, wherein the ejection amount of each liquid droplet of the liquid-droplet group continuously ejected from the nozzle toward one landing point is fixed or approximated at constant corresponding to a predetermined frequency band of the pulse signal, and liquid is ejected by variably controlling the drive frequency of the pulse signal within the frequency band.

By such a structure, the ejection amount of each liquid droplet of the liquid-droplet group continuously ejected from the liquid-ejecting hole toward one landing point by the pulse signals generated by the pulse-signal generating means is fixed or approximated at constant corresponding to a predetermined frequency band of the pulse signal, and liquid is ejected by variably controlling a drive frequency of the pulse signal within the frequency band, so that the ejection amount of each liquid droplet of the continuously ejected liquid-droplet group can be stabilized corresponding to a predetermined frequency band of the pulse signal.

Furthermore, in order to achieve the second object, a liquid-ejecting apparatus according to the present invention comprises a head having a plurality of lining liquid-ejecting units, each having a nozzle; ejecting-direction deflecting means for deflecting the ejecting direction of a liquid droplet ejected from the nozzle of one liquid-ejecting unit so that the liquid droplet is landed at a position or in the vicinity of the position where the liquid droplet from the nozzle of another liquid-ejecting unit located in the vicinity of the one liquid-ejecting unit is landed without deflection; and ejection-controlling means for controlling the ejection so that when one pixel is formed by landing a plurality of liquid droplets so that at least part of landing regions are overlapped with each other, one of two pixels neighboring in a direction perpendicular to the arranging direction of the liquid-ejecting units is formed by a plurality of droplets ejected from the nozzle of one liquid-ejecting unit while the other pixel is formed by a plurality of droplets ejected from the nozzle of the liquid-ejecting unit different from the one liquid-ejecting unit.

According to the present invention, while a liquid droplet from the nozzle of each liquid-ejecting unit can be ejected without deflection, by deflecting the ejecting direction, a liquid droplet can be landed at a position or in the vicinity of the position where the liquid droplet from the nozzle of another liquid-ejecting unit located in the vicinity of the one liquid-ejecting unit is landed without deflection.

For example, when liquid droplets are ejected from a neighboring liquid-ejecting unit x and a liquid-ejecting unit (x+1), landing positions when liquid droplets are ejected without deflection from the liquid-ejecting unit x and the liquid-ejecting unit (x+1) are defined as a landing position x and a landing position (x+1), respectively. The liquid-ejecting unit x can eject a liquid droplet without deflection so as to be landed at the landing position x, and also it can land a liquid droplet at the landing position (x+1) by deflecting the ejecting direction of the liquid droplet. Similarly, the liquid-ejecting unit (x+1) can eject a liquid droplet without deflection so as to be landed at the landing position (x+1), and also it can land a liquid droplet at the landing position x by deflecting the ejecting direction of the liquid droplet.

Then, when a pixel is formed by landing a plurality of liquid droplets so that at least part of landing regions are overlapped with each other, a liquid-ejecting unit used for forming the pixel is only one liquid-ejecting unit.

For forming other pixels neighboring in a direction perpendicular to the arranging direction of the liquid-ejecting units, a liquid-ejecting unit different from the one liquid-ejecting unit, such as one of other liquid-ejecting units neighboring in the arranging direction of the liquid-ejecting units, is used.

BRIEF DESCRIPTION OF THE DRAWINGS

FIGS. 3A and 3B are explanatory views showing the structure of a line head for one color provided in the print head shown in FIG. 2, wherein FIG. 3A is a plan view and FIG. 3B is a bottom view;

DESCRIPTION OF THE PREFERRED EMBODIMENTS

Figure 1:
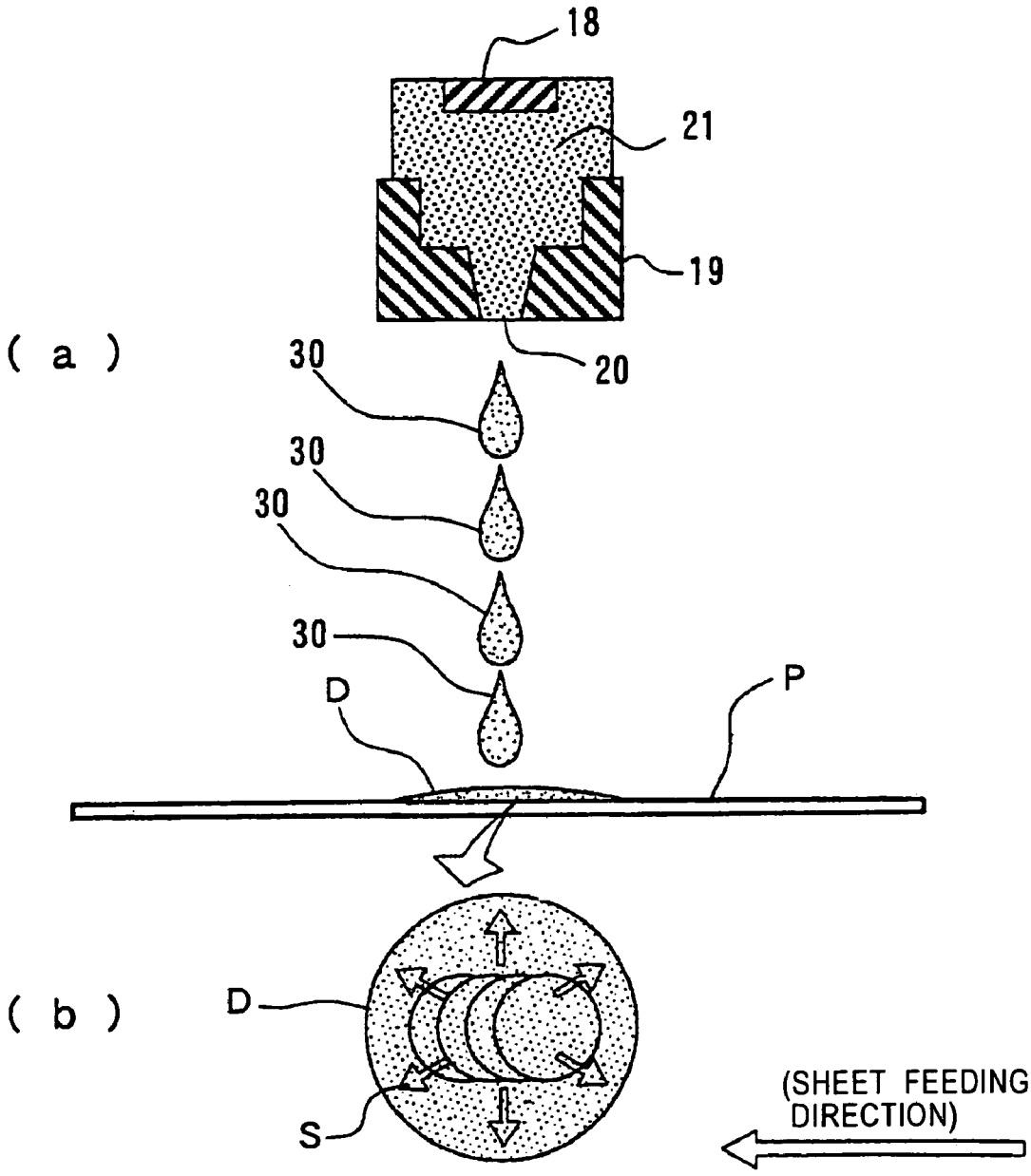
FIGS. 1A and 1B are schematic views of an embodiment of a liquid-ejecting method according to the present invention, showing a state that ink contained in an ink chamber is ejected from a nozzle as an ink droplet group.

An embodiment according to the present invention will be described below with reference to the drawings. In the description below, an inkjet printer (simply referred to as a printer below) is exemplified as an example of a liquid-ejecting apparatus according to the present invention.

In the specification, an "ink droplet" is referred to as a micro amount (several picoliter, for example) of ink (liquid) ejected from a nozzle 20 of a liquid-ejecting unit, which will be described later. Also, a "dot" means a substance formed on a recording medium such as a photographic sheet by one link droplet landed thereon.

Furthermore, a "pixel" means a minimum unit of an image, and a "pixel region" is defined as a region for forming a pixel thereon.

On one pixel region, a predetermined number of liquid droplets are landed so as to form a pixel without a dot (with one-step gradation) or a pixel composed of a plurality of dots (with three-step or more gradation). That is, to one pixel region, zero, one, or plural dots correspond. An image is formed by arranging a number of these pixels on a recording medium.

In addition, a dot corresponding to a pixel does not necessarily fall within its pixel region completely, and it may protrude off the pixel region.

A "principal scanning direction" is defined as a conveying direction of a photographic sheet in a line-type printer having a line head mounted thereon. Whereas in a serial-type printer, the moving direction of a head (the width direction of the photographic sheet) is referred as a "principal scanning direction" and a conveying direction of a photographic sheet, i.e., a direction perpendicular to the principal scanning direction, is defined as a "secondary scanning direction".

A "pixel row" is referred as a pixel group lining in the principal scanning direction. Therefore, in the line-type printer, a pixel group lining in the conveying direction of a photographic sheet denotes the "pixel row". Whereas in the serial-type printer, a pixel group lining in the moving direction of the head represents the "pixel row".

A "pixel line" denotes a direction perpendicular to the pixel row. For example, in the line-type printer, the lining direction of liquid-ejecting units (or nozzles) is referred to as the line.

An embodiment for achieving a first object of the present invention will be described below.

FIGS. 1A and 1B are schematic views of an embodiment of a liquid-ejecting method according to the present invention. This liquid-ejecting method is for ejecting liquid contained in a liquid chamber as continuous liquid-droplet groups from a nozzle. Referring to FIGS. 1A and 1B, a nozzle member 19, which will be described later, is provided with a nozzle 20 formed therein, and an ink chamber 21 formed corresponding to the nozzle 20 is provided with a heating resistor 18 arranged therein. In such a state, ink contained in the ink chamber 21 is ejected as a continuous liquid-droplet group 30, 30, . . . from the nozzle 20 by feeding a pulse signal to the heating resistor 18.

According to the liquid-ejecting method of the present invention, the ejection amount of each liquid droplet of the liquid-droplet group 30, 30, . . . continuously ejected from the nozzle 20 toward one landing point on a recording sheet P by continuous pulse signals is fixed or approximated at constant corresponding to a predetermined frequency band of the pulse signal, and ink is ejected by variably controlling a drive frequency of the pulse signal within the frequency band.

That is, the ink chamber 21 is replenished with the same amount of ink as that of the ink droplet ejected from the nozzle 20 in a predetermined frequency band of the pulse signal. The degree of negative pressure applied to ink in the ink chamber 21 in a predetermined frequency band of the pulse signal is the same as under that the surface (meniscus) of ink in the nozzle 20 is not drawn back toward the ink chamber 21. Structures for achieving these will be described later in detail.

Figure 2:
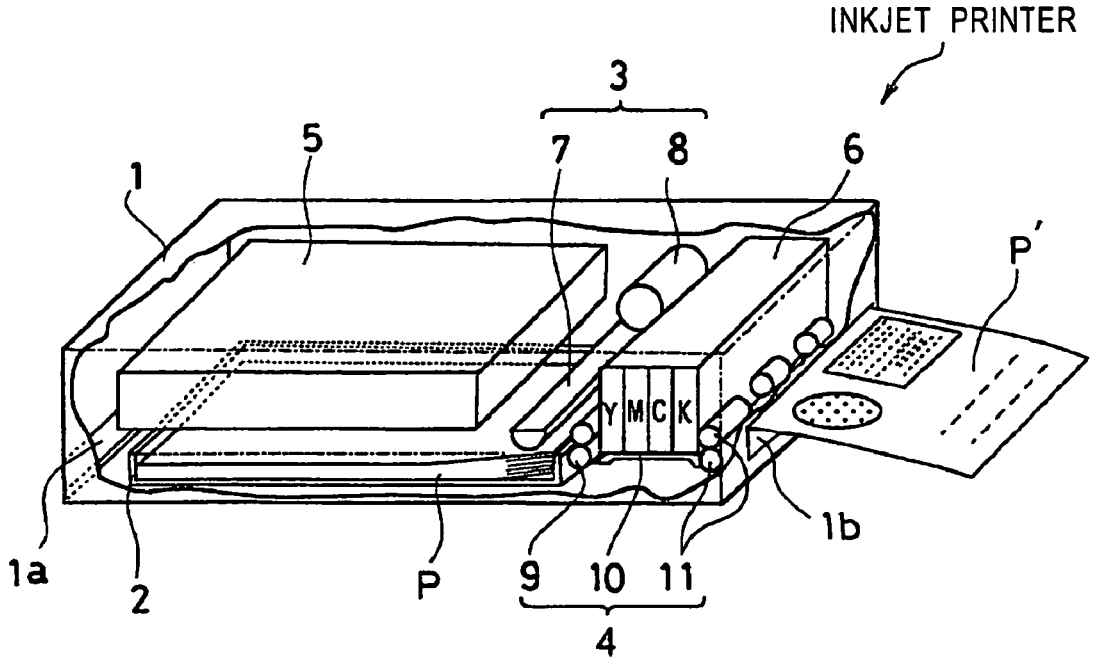
FIG. 2 is a perspective partially broken away view of a specific embodiment of an inkjet printer as an apparatus directly used in the implementation of the liquid-ejecting method according to the present invention.

FIG. 2 is a perspective partially broken away view of a specific embodiment of an inkjet printer as an apparatus directly used in the implementation of the liquid-ejecting method according to the present invention. This inkjet printer is for forming printed images by ejecting ink in the ink chamber 21 from the nozzle 20 as ink droplets so as to accrete the ink droplets on a recording sheet (recording medium), and includes a sheet tray 2, sheet feeding means 3, sheet transferring means 4, an electrical circuit unit 5, and a print head 6 arranged in a casing 1.

The casing 1 is a box-like body accommodating structural components of the inkjet printer therein, and is formed in a rectangular body shape, for example, with one end being provided with a tray gateway 1*a* for mounting the sheet tray 2, which will be described later, and with the other end being provided with a sheet exit 1*b* for discharging a printed recording sheet P'. Within the casing 1, the sheet tray 2 is accommodated. The sheet tray 2 can accommodate a plurality of recording sheets P in A-4 size in piles, for example, and the leading edge side thereof is formed so as to upward raise the recording sheet P. The sheet tray 2 is to be mounted within the casing 1 from the tray gateway 1*a* arranged on one end face of the casing 1.

Above the leading edge side of the sheet tray 2 accommodated in the casing 1, the sheet feeding means 3 is provided. The sheet feeding means 3 is for supplying the recording sheet P accommodated in the sheet tray 2 to the sheet transferring means 4, which will be described later, and includes a feeding roller 7 and a feeding motor 8. The feeding roller 7 is formed in a substantial semicircular cylindrical shape, for example, so as to feed only the top recording sheet P of the recording sheets P piled on the sheet tray 2 toward the sheet transferring means 4. The feeding motor 8 is for rotating the feeding roller 7 via gears (not shown), and arranged above the feeding roller 7, for example.

Also, below a print head 6, which will be described later, the sheet transferring means 4 is arranged in a direction supplying the recording sheet P by the sheet feeding means 3. The sheet transferring means 4 is for conveying the recording sheet P supplied by the sheet feeding means 3 toward the sheet exit 1*b* disposed on the other end face of the casing 1, and includes a first feeding roller 9 and a second feeding roller 11. The first feeding roller 9 is for conveying the recording sheet P supplied by the sheet feeding means 3 toward a feeding guide 10, and rotates pinching the recording sheet P between a pair of roller members contacting each other in the vertical direction. Also the feeding guide 10 is for guiding the recording sheet P conveyed from the first feeding roller 9 to the second feeding roller 11, and it is formed in a flat-plate shape and arranged below the print head 6 spaced at a predetermined interval. Furthermore, the second feeding roller 11 is for conveying the recording sheet P guided by the feeding guide 10 toward the sheet exit 1*b* disposed on the other end face of the casing 1, and rotates pinching the recording sheet P between a pair of roller members contacting each other in the vertical direction.

Furthermore, above the sheet tray 2, the electrical circuit unit 5 is arranged. The electrical circuit unit 5 is for controlling the operation of the sheet feeding means 3 and the sheet transferring means 4, and constitutes pulse-signal generating means for generating a pulse signal for ejecting ink from a liquid-ejecting unit (not shown) arranged in the print head 6, which will be described later, including an arithmetic unit such as a power supply for generating continuous pulse signals and a CPU or a memory for storing various correction data, for example.

Above the sheet transferring means 4, the print head 6 is arranged. The print head 6 is for ejecting liquid ink by making it into droplets so as to form a printed image by spraying the ink droplets on the recording sheet P, having a PNM-type modulation function to express gradation by changing the diameter of a pixel constituting the printed image. The print head 6 accommodates four-color ink of yellow Y, magenta M, cyan C, and black K, and has a line head (see FIGS. 3A and 3B) ejecting the four-color ink of YMCK for each color. In addition, in the description below, the print head 6 is described as a line-type liquid-ejecting unit (not shown) arranged corresponding to the overall width of the recording sheet P.

In the specification, a portion constituted by one ink chamber 21, the heating resistor 18 arranged within the ink chamber 21, and the nozzle 20 arranged above the heating resistor 18 is referred as an "ink-ejecting unit (equivalent to the liquid-ejecting unit according to the present invention)". That is, a line head 12 may be an element having a plurality of the juxtaposed ink-ejecting units. The print head 6 will be described below in detail.

Figure 3A:
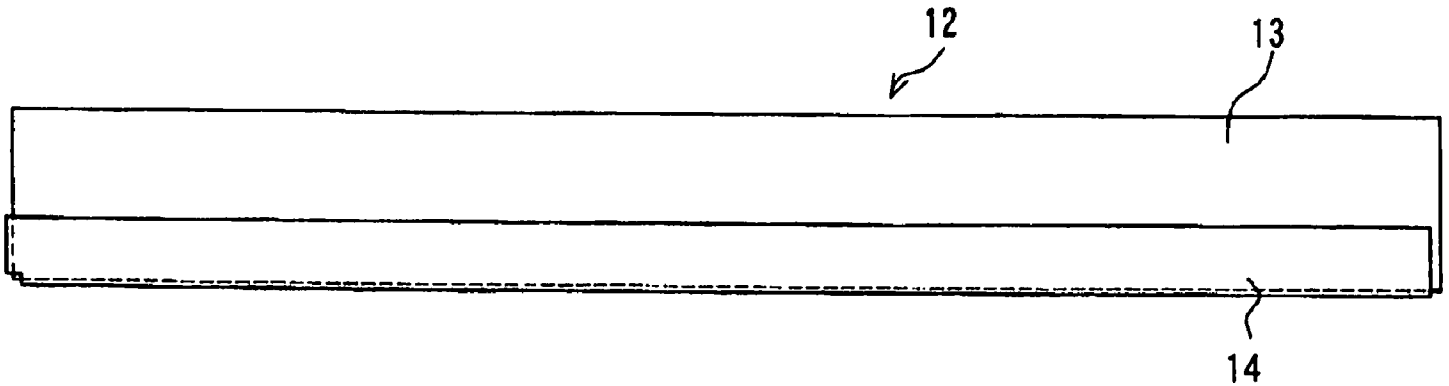
Figure 3B:
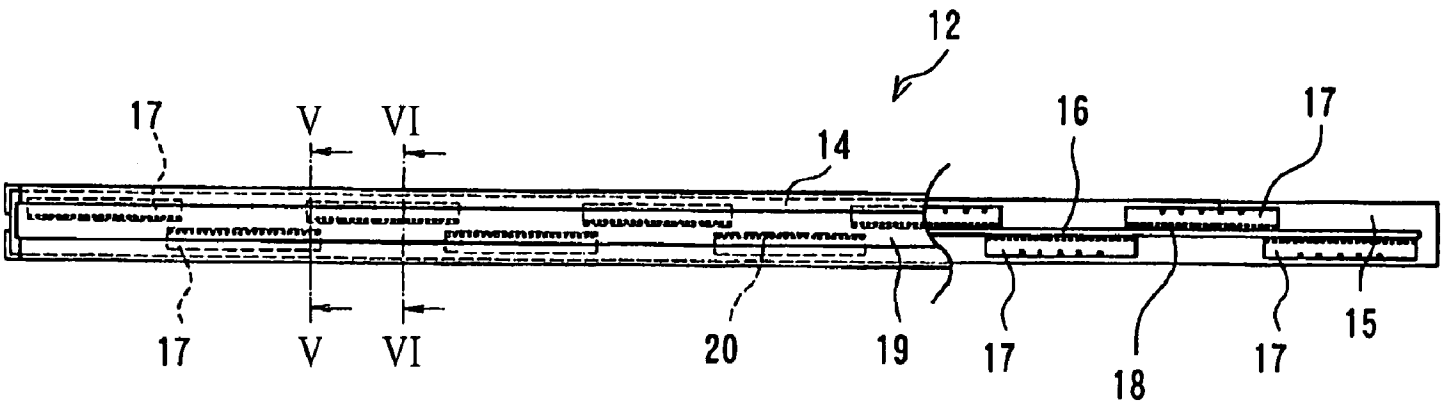

FIGS. 3A and 3B are explanatory views showing the structure of the line head 12 for one color provided in the print head 6 shown in FIG. 2. The line head 12 is for ejecting ink of each color by making it into micro liquid-droplets, and includes an ejecting unit (nozzle) directed downward, an external casing 13 having a length corresponding to the overall width of the recording sheet P shown in FIG. 2 so as to cover the line head 12 as shown in FIG. 3A, and electrical wiring 14 arranged under the external casing 13. The electrical wiring 14 is connected to the electrical circuit unit 5 shown in FIG. 2 for receiving continuous pulse signals produced in the electrical circuit unit 5 so as to feed the pulse signals to a head chip 17, which will be described later. As shown in FIG. 3B, on the bottom surface of the line head 12, a linear head frame 15 is provided. A slit ink-feed opening 16 is formed to extend along the longitudinal direction of the head frame 15. A plurality of the head chips 17, 17, . . . are alternately arranged on right and left sides of the ink-feeding opening 16. On the bottom surface of each head chip 17, a number of the heating elements 18 are arranged for generating energy for ejecting ink from the nozzle 20, which will be described later.

Figure 4:
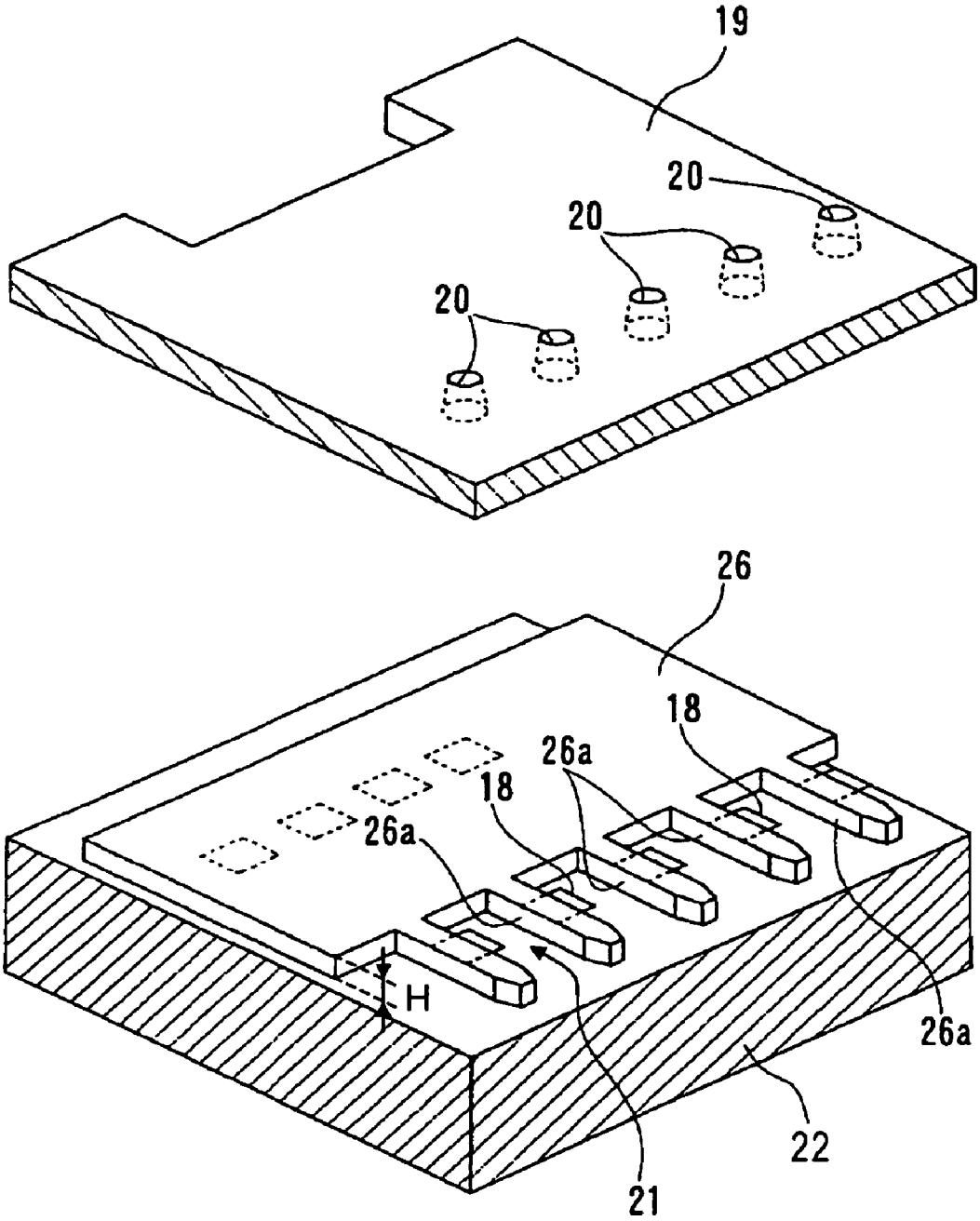
FIG. 4 is an enlarged view of an essential part of the line head shown in FIGS. 3A and 3B.

FIG. 4 is an enlarged view of an essential part of the line head 12 shown in FIGS. 3A and 3B. Referring to FIG. 4, the nozzle member 19 is bonded on a barrier layer 26, and the nozzle member 19 is shown by taking it apart.

The head chip 17 is formed of a semiconductor substrate 22 made of silicon and having the heating resistor 18 (equivalent to energy generating means according to the present invention) deposited on one surface of the semiconductor substrate 22. The heating resistor 18 is electrically connected to an external circuit via a conduction unit (not shown) formed on the semiconductor substrate 22.

The barrier layer 26 is made of a photosensitive cyclized rubber resist or an exposure curing dry-film resist, and formed to have a predetermined thickness H by depositing the resist on the entire surface of the semiconductor substrate 22, on which the heating resistor 18 is formed, and then by removing unnecessary parts therefrom by a photolithographic process. The thickness H of the barrier layer 26 becomes equivalent to the height H of the ink chamber 21 (see FIG. 6).

Moreover, the nozzle member 19, having a plurality of the nozzles 20 formed thereon, is made of nickel by electrical casting, for example, and bonded on the barrier layer 26 so that the position of the nozzle 20 corresponds with that of the heating resistor 18, i.e., so that the nozzle 20 opposes the heating resistor 18. The nozzle member 19 may also be plated with palladium or gold for preventing corrosion due to ink. The nozzle member 19 is provided with a number of the nozzles 20 formed along the longitudinal direction. Wherein, the nozzles 20 are arranged so as to have a resolution of 600 dpi, for example, of printed images formed on the recording sheet P' shown in FIG. 2. If the nozzles 20 are arranged so as to have a resolution of 600 dpi, ctenidia 26*a*, 26*a*, . . . of the comb-shaped barrier layer 26 are arranged approximately at an interval of 42.3 μm.

The ink chamber 21 (equivalent to the liquid chamber according to the present invention) is composed of a substrate member 22, the barrier layer 26, and the nozzle member 19 so as to surround the heating resistors 18. That is, as shown in the drawing, the substrate member 22 constitutes the bottom wall of the ink chamber 21; the barrier layer 26 constitutes the sidewall of the ink chamber 21; and the nozzle member 19 constitutes the top wall of the ink chamber 21. Thereby, the ink chamber 21 has opening regions disposed in the front of the right side in FIG. 4, and the opening regions are communicated with an ink-flow path (not shown).

Figure 5:
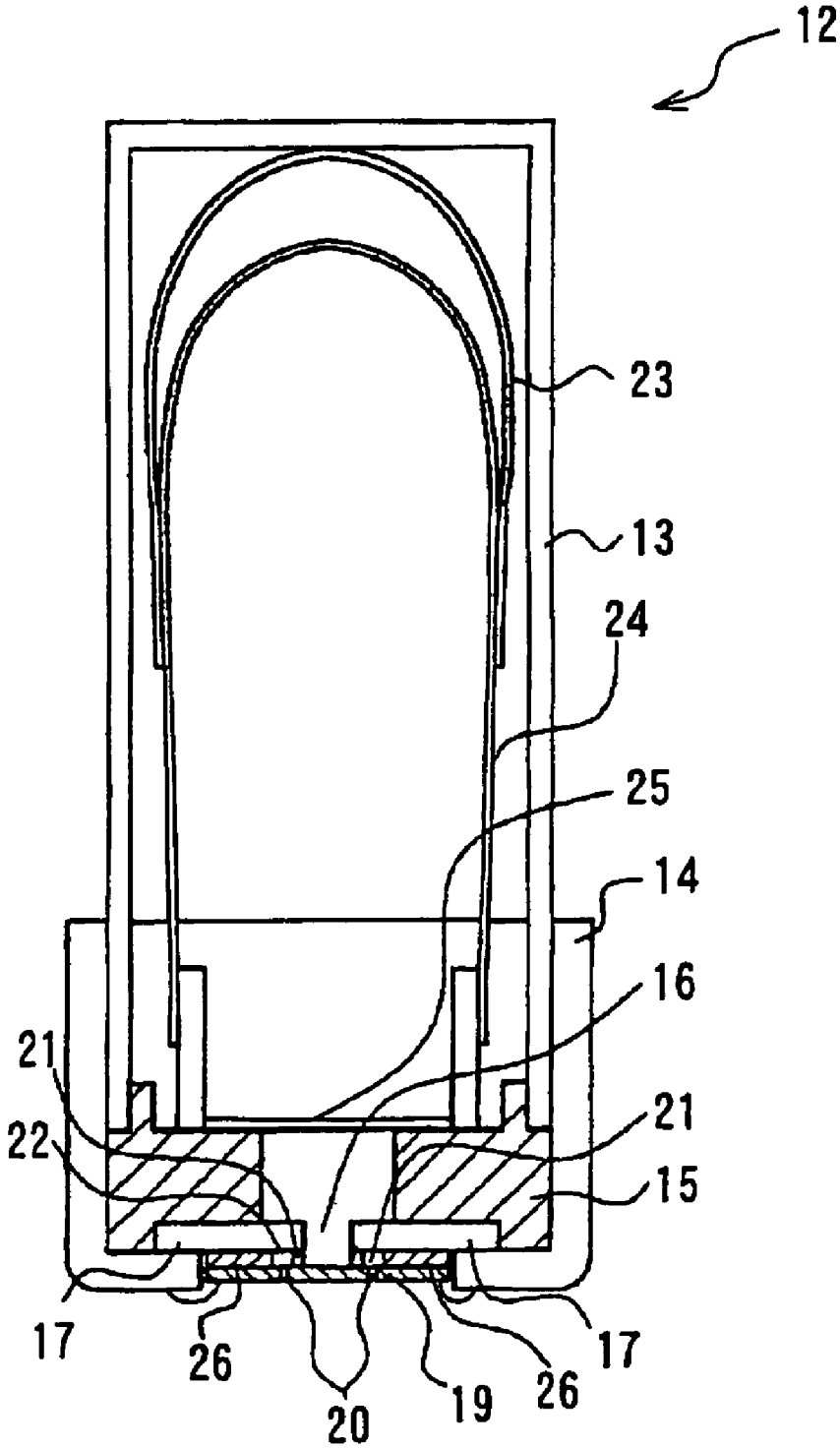
FIG. 5 is a sectional view at the line of V-V of FIG. 3B.
Figure 6:
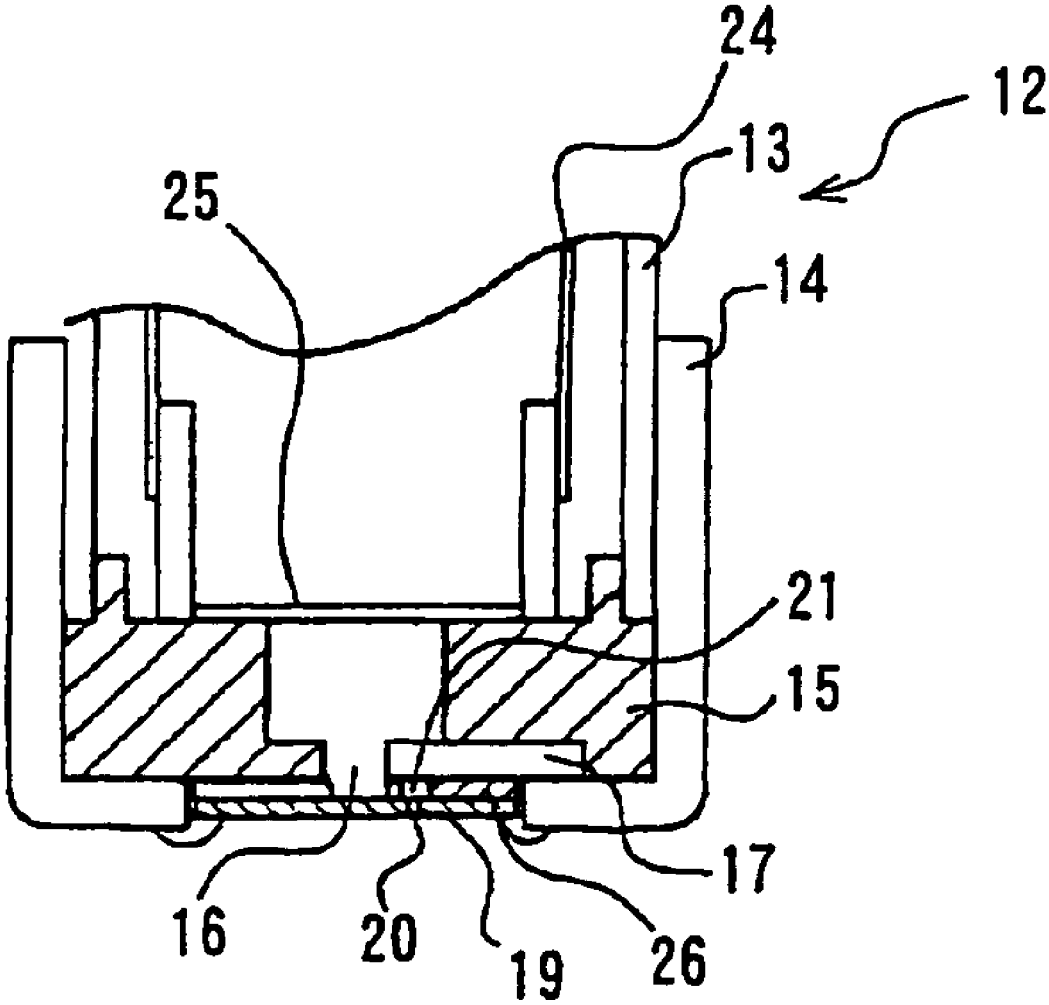
FIG. 6 is a sectional view at the line of VI-VI of FIG. 3B.

Such a sectional structure of the line head 12 will be described with reference to FIGS. 5 to 7. FIG. 5 is a sectional view at the line of V-V of FIG. 3B; and FIG. 6 is a sectional view at the line of VI-VI of FIG. 3B. As shown in FIG. 5 or FIG. 6, at the position corresponding to the nozzle 20 (see FIG. 3B) formed on the sheet-like nozzle member 19, the ink chamber 21 is formed. From the ink-feed opening 16 (see FIG. 3B), ink is supplied to the ink chamber 21. As shown in FIG. 5, between the external casing 13 (see FIG. 3A) and a bag member 24 having ink contained therein, a spring member 23 is provided. The spring member 23 functions as negative pressure generating means for preventing ink from spontaneously leaking from the nozzle 20 by applying the negative pressure to the ink replenished within the ink chamber 21 so as to outward extend the bag member 24. The spring member 23 can freely establish the negative pressure applied to ink by adjusting the force exerted to outwardly extend the bag member 24.

Referring to FIG. 5 or FIG. 6, a filter 25 is bonded to cover the ink-feed opening 16 so as to filtrate dirt and aggregate of ink ingredients mixed in the ink accommodated in the bag member 24. Owing to the filter 25, the dirt, etc., mixed in ink cannot drop toward the ink-feed opening 16, preventing the nozzle 20 from clogging.

One of the head chips 17 is generally provided with the ink chambers 21 in 100 pieces, each ink chamber 21 having the heating resistor 18 arranged therein. By a command from a control unit of the printer, each of these heating resistors 18 is uniquely selected so as to eject the ink contained in the ink chamber 21 corresponding to this heating resistor 18 from the nozzle 20 opposing this ink chamber 21.

That is, the ink chamber 21 is filled with ink from the bag member 24 connected to the ink-feed opening 16 via the ink-feed opening 16. Then, by passing pulse current through the heating resistor 18 for a short time, 1 to 3 μsec, for example, the heating resistor 18 is rapidly heated. As a result, vapor-phase ink bubbles are generated in a portion contacting the heating resistor 18, and by the expansion of the ink bubbles, certain volume of ink is displaced (ink comes to a boil). Thereby, the same volume of ink located on the nozzle 20 as that of the above-mentioned displaced ink is ejected from the nozzle 20 as ink droplets so as to land on the photographic sheet for forming a dot thereon.

Figure 7:
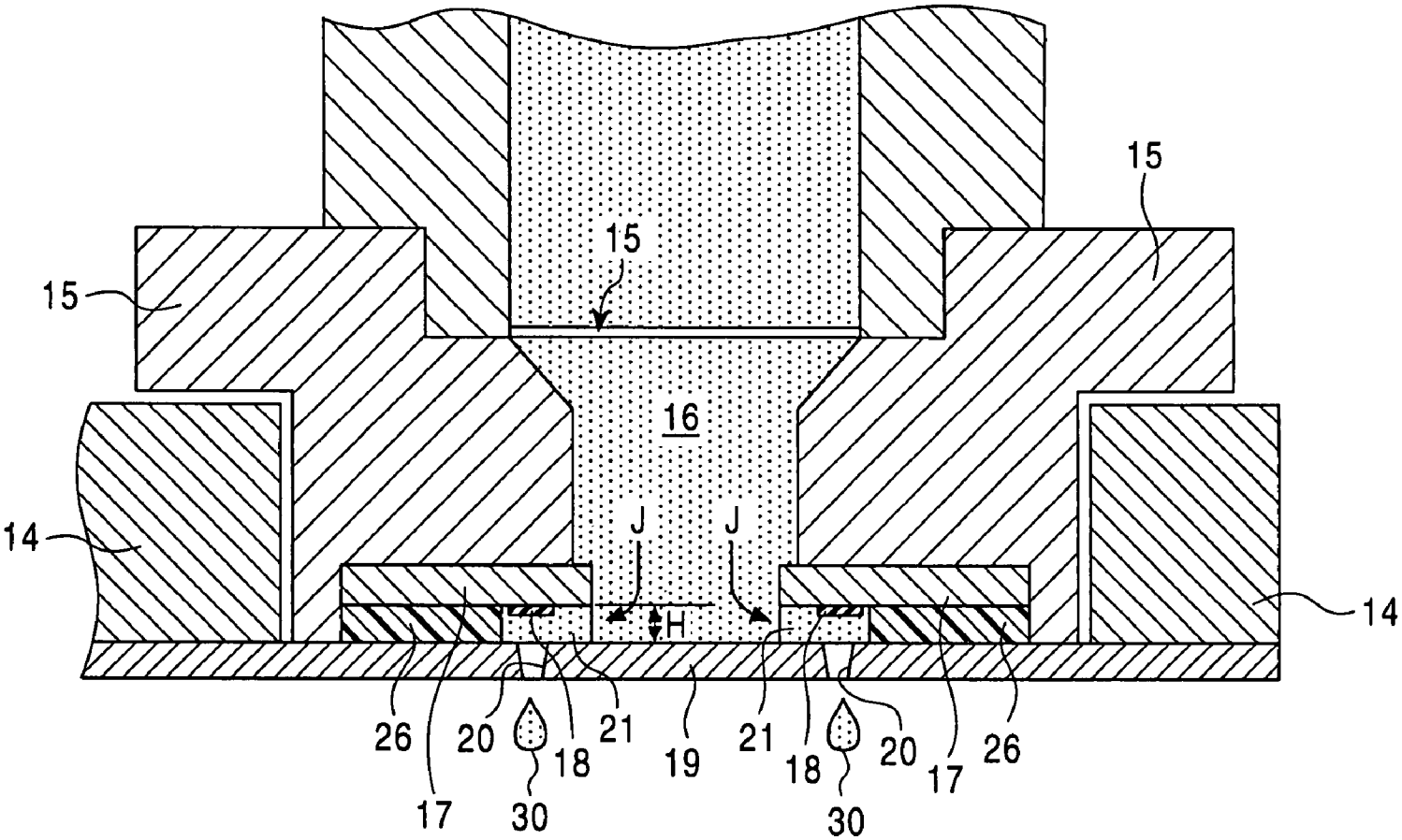
FIG. 7 is an enlarged view of an essential part of a line head shown in FIG. 5.

That is, as shown in FIG. 7, the pulse signal generated by the electrical circuit unit 5 (see FIG. 2) heats the heating resistor 18 formed on the surface of the head chip 17 so as to displace the ink contained in the ink chamber 21 by bubbles generated in the heated ink, resulting in ejecting an ink droplet 30 from the nozzle 20 so as to be landed on a photographic sheet for forming a dot thereon. Then, as shown by arrows J, the ink chamber 21 is replenished with ink through the ink-feed opening 16 so as to cool the heating resistor 18, resulting in eliminating the bubbles by the cooling.

In the electrical circuit unit 5 (see FIG. 2), continuous pulse signals are generated so as to supply them to the heating resistor 18 (see FIG. 7). Thereby, as shown in FIG. 1A, ink contained in the ink chamber 21 is ejected from the nozzle 20 toward one pixel D on the recording sheet P as a continuous ink-droplet group 30, 30, . . . . The ink-droplet group 30, 30, . . . ejected on the recording sheet P, as shown in FIG. 1B, extends in directions of arrows S to form the one pixel D. At this time, by adjusting the number of times of forming the pulse signal so as to adjust the number of the droplets 30 ejected from the nozzle 20, the diameter of the pixel D bonded on the recording sheet P is changed, expressing gradation.

In the liquid-ejecting apparatus according to the present invention, as shown in FIGS. 1A and 1B, the ejection amount of each liquid droplet of the liquid-droplet group continuously ejected toward one landing point by the continuous pulse signals is fixed or approximated at constant corresponding to a predetermined frequency band of the pulse signal, and liquid is ejected by variably controlling a drive frequency of the pulse signal within the frequency band.

Specifically, in the ink chamber 21 shown in FIG. 7, the opening disposed in the ink-feeding side to the ink chamber 21 is formed to have a height capable of passing the same amount of ink as that of the ink-droplet group 30, 30, . . . ejected from the nozzle 20 in a predetermined frequency band of the pulse signal. For example, the height of the ink chamber 21, i.e., the height H of the barrier layer 26 is be 11 μm.

Figure 8:
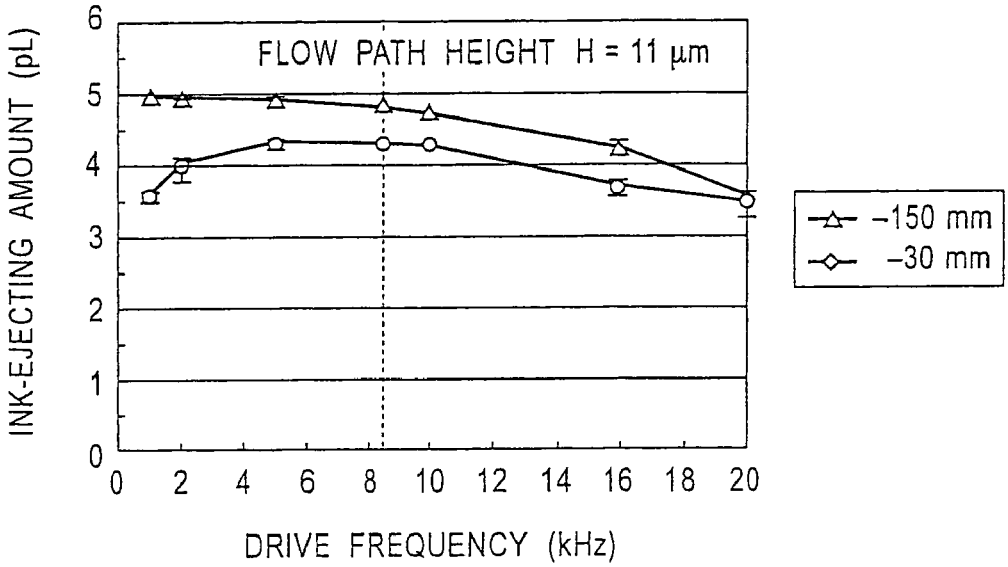
FIG. 8 is a graph showing the relationship between the drive frequency of a pulse signal and the ink-ejection amount when the height of an ink flow path shown in FIG. 7 is 11 μm.
Figure 9:
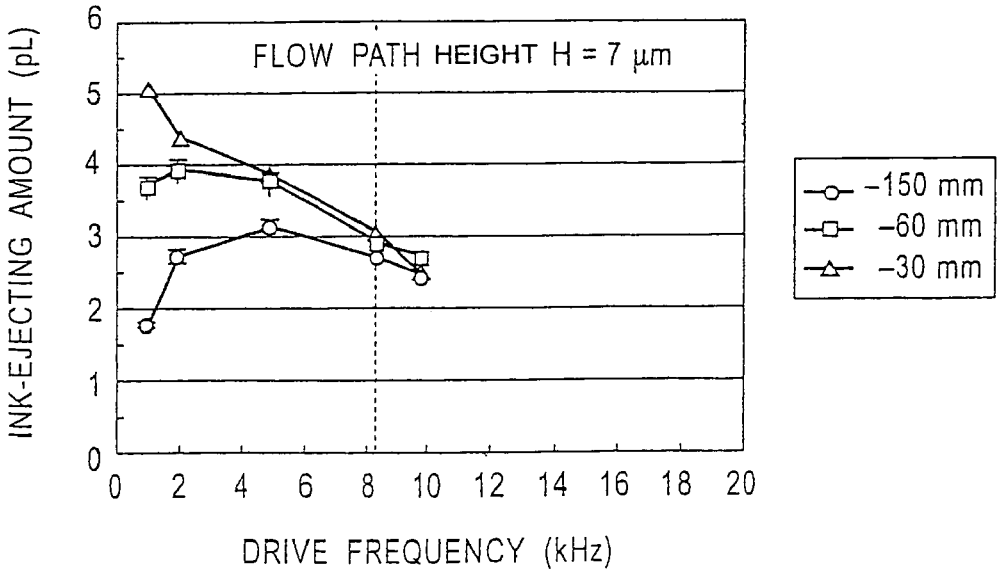
FIG. 9 is a graph showing the relationship between the drive frequency of a pulse signal and the ink-ejection amount when the height of an ink flow path shown in FIG. 7 is 7 μm.

The reason why the height H of the ink chamber 21 is 11 μm will be described with reference to FIGS. 8 and 9. FIG. 8 is a graph showing the relationship between the drive frequency of the pulse signal and the ink-ejection amount in the case where the height H of the ink chamber 21 shown in FIG. 7 is 11 μm. Also, FIG. 9 is a graph showing the relationship between the drive frequency of the pulse signal and the ink-ejection amount in the case where the height H of the ink chamber 21 is 7 μm. Referring to FIGS. 8 and 9, when the negative pressure of the spring member 23 shown in FIG. 5 is −150 $mmH_2O$, ink-ejection amount characteristics are indicated by circular symbol (○); when the negative pressure of the spring member 23 shown in FIG. 5 is −60 $mmH_2O$, ink-ejection amount characteristics are indicated by rectangular symbol (□); when the negative pressure of the spring member 23 shown in FIG. 5 is −30 $mmH_2O$, ink-ejection amount characteristics are indicated by triangular symbol (Δ).

As shown in FIG. 8, in the case where the height H of the ink chamber 21 (see FIG. 7) is 11 μm, the ejection amount of the ink droplet ejected from the nozzle 20 can be fixed or approximated at constant corresponding to a wide frequency band of the pulse signal of approximately 1 KHz to 10 KHz. Whereas, as shown in FIG. 9, in the case where the height H of the ink chamber 21 is 7 μm, the ink-ejection amount tends to decrease as the drive frequency of the pulse signal increases from 5 KHz, for example. The reason is that in the case where the height H of the ink chamber 21 shown in FIG. 7 is as small as 7 μm, the ink chamber 21 is difficult to be replenished again with the same amount of ink as that of the ink droplet ejected from the nozzle 20 in a high drive frequency band of the pulse signal. In this case, since the amount of ink replenishing the ink chamber 21 again is reduced, the ink-ejection amount is decreased in comparison with the case where the drive frequency of the pulse signal is lower than 5 KHz. Therefore, it is preferable that the height H of the ink chamber 21 be increased to 11 μm, for example.

In the spring member 23 shown in FIG. 5, it is established that the degree of negative pressure applied to ink in the ink chamber 21 in a predetermined frequency band of the pulse signal is the same as under that the surface of ink in the nozzle 20 is not drawn back toward the ink chamber 21. For example, the negative pressure of the spring member 23 is set at −30 $mmH_2O$.

Figure 10:
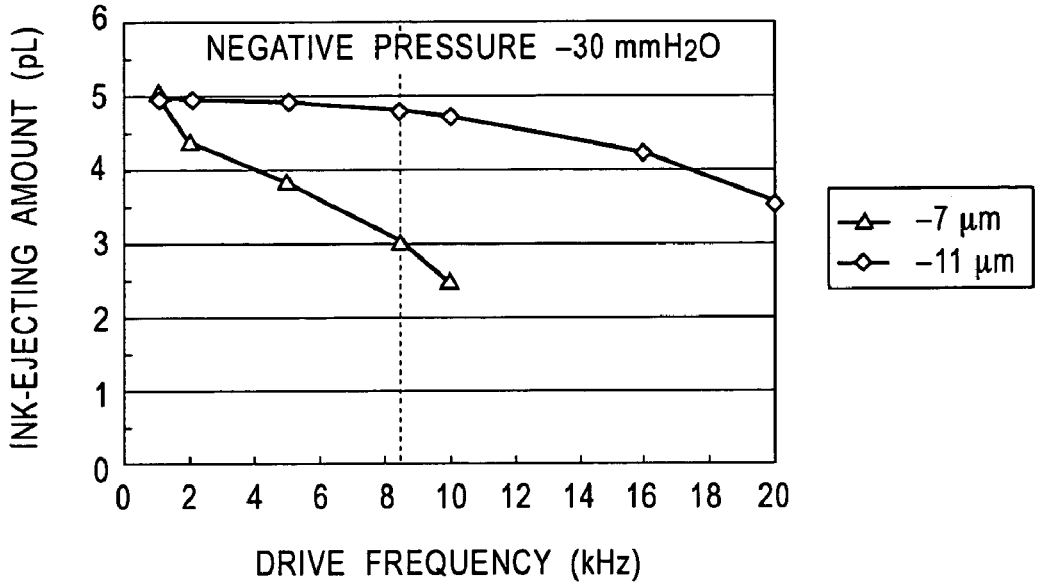
FIG. 10 is a graph showing the relationship between the drive frequency of a pulse signal and the ink-ejection amount when the negative pressure of a spring member shown in FIG. 5 is set at −30 $mmH_2O$.
Figure 11:
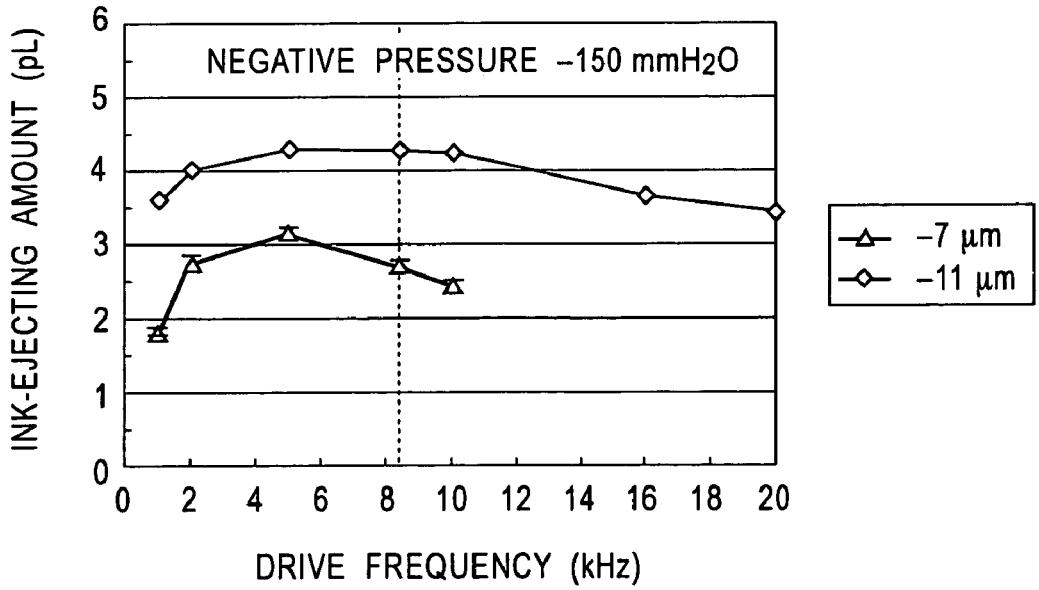
FIG. 11 is a graph showing the relationship between the drive frequency of a pulse signal and the ink-ejection amount when the negative pressure of the spring member shown in FIG. 5 is set at −150 $mmH_2O$.

The reason why the negative pressure of the spring member 23 is set at −30 $mmH_2O$ will be described with reference to FIGS. 10 and 11. FIG. 10 is a graph showing the relationship between the drive frequency of the pulse signal and the ink-ejection amount when the negative pressure of the spring member 23 is set at −30 $mmH_2O$; and FIG. 11 is a graph showing the relationship between the drive frequency of the pulse signal and the ink-ejection amount when the negative pressure of the spring member 23 is set at −150 $mmH_2O$. Referring to FIGS. 10 and 11, when the height H of the ink chamber 21 shown in FIG. 7 is 7 μm, ink-ejection amount characteristics are indicated by triangular symbol (Δ); and when the height H of the ink chamber 21 is 11 μm, ink-ejection amount characteristics are indicated by rectangular symbol (□).

As shown in FIG. 10, in the case where the negative pressure of the spring member 23 (see FIG. 4) is set at −30 $mmH_2O$ and the height H of the ink chamber 21 is 11 μm, the ejection amount of the ink droplet ejected from the nozzle 20 can be fixed or approximated at constant corresponding to a wide frequency band of the pulse signal of approximately 1 KHz to 10 KHz. Whereas, as shown in FIG. 11, in the case where the negative pressure of the spring member 23 (see FIG. 5) is set at −150 $mmH_2O$, in any of when the height H of the ink chamber 21 is 7 μm and when it is 11 μm, the ink-ejection amount tends to decrease as the drive frequency of the pulse signal decreases smaller than 5 KHz, for example. The reason is that in the case where the negative pressure of the spring member 23 shown in FIG. 5 is large as −150 $mmH_2O$, the surface of ink in the nozzle 20 is liable to be drawn back toward the ink chamber 21 in a low drive frequency band of the pulse signal. In this case, since the amount of ink replenishing the ink chamber 21 again is reduced, the ink-ejection amount is decreased in comparison with the case where the drive frequency of the pulse signal is higher than 5 KHz. Therefore, it is preferable that the negative pressure of the spring member 23 be set small as at −30 $mmH_2O$, for example.

In the above description, the height H of the ink chamber 21 is 11 μm, and the negative pressure of the spring member 23 is set at −30 $mmH_2O$; however, the present invention is not limited to this, and the height H of the ink chamber 21 may be enough as, long as the height is capable of replenishing the chamber with the same amount of ink as that of the ink-droplet group 30, 30, . . . ejected from the nozzle 20 in a predetermined frequency band (high frequency) of the pulse signal. Specifically, the height H is determined by the space between the ctenidia 26*a* of the comb-shaped barrier layer 26, which is the width of the ink chamber 21 shown in FIG. 4, that is, the flow path resistance. Accordingly, when the space between the ctenidia 26*a* of the barrier layer 26 is further reduced in order to improve image resolution, it is necessary to improve the flow path shape so as not to increase the flow path resistance. As one method, the height H of the ink chamber 21 may be increased. Also, the negative pressure of the spring member 23 is not limited to −30 $mmH_2O$; alternatively, it may be enough as long as the surface (meniscus) of ink in the nozzle 20 is not drawn back toward the ink chamber 21 in a predetermined frequency band (low frequency) of the pulse signal.

Next, the operation of the inkjet printer structured in such a manner as a liquid-ejecting apparatus will be described. First, referring to FIG. 2, the recording sheet P accommodated in the sheet tray 2 is supplied toward the sheet transferring means 4 by the sheet feeding means 3 so as to pass through under the print head 6. At this time, the print head 6 ejects four-color ink of YMCK from the ejection unit (see FIG. 3B) as ink droplets so as to form printed images on the recording sheet P. The printed recording sheet P' is discharged from the sheet exit 1*b* disposed on the other end face of the casing 1.

The operation of the print head 6 will be described. First, as shown in FIG. 7, the ink chamber 21 formed corresponding to the nozzle 20 is replenished with ink, and continuous pulse signals are generated in the electrical circuit unit 5 (see FIG. 2) and fed to the heating resistor 18 disposed within the ink chamber 21 so as to repeatedly heat the heating resistor 18. Thereby, as shown in FIG. 1, ink contained in the ink chamber 21 is ejected from the nozzle 20 as an ink-droplet group 30, 30, . . . .

As described above, the height H of the ink chamber 21 is 11 μm, for example. Thereby, as shown by arrows J, the ink chamber 21 is replenished again with the same amount of ink as that of ink droplets ejected from the nozzle 20 in a predetermined frequency band (high frequency) of the continuous pulse signals. Also, the negative pressure of the spring member 23 is set at −30 $mmH_2O$, for example. Thereby, by the negative pressure of the spring member 23 applied to ink contained within the ink chamber 21, in a predetermined frequency band (low frequency) of the continuous pulse signals, the surface of ink in the nozzle 20 can be prevented from being drawn back toward the ink chamber 21.

Therefore, by the continuous pulse signals, the ejection amount of each ink droplet of the ink-droplet group 30, 30, . . . continuously ejected from the nozzle 20 toward one pixel D can be quantifiably fixed or approximated at constant corresponding to a wide frequency band of the pulse signal. Specifically, as is indicated by triangular symbol (Δ) in FIG. 8, by corresponding to a predetermined frequency band (appropriately 1 KHz to 10 KHz, for example) of the pulse signal, the ejection amount of each ink droplet 30 can be stably fixed or approximated at constant (5 to 4.8 picoliter, for example). Then, within the wide frequency band, liquid can be ejected by variably controlling a drive frequency of the pulse signal. Thereby, the drive frequency of the continuous pulse signals can be arbitrarily set, so that printed images can be formed by dispersing the pulse signal for supplying to the heating resistor 18 (see FIG. 3B) disposed in the nozzle 20. In this case, the voltage of a power supply for supplying electric power to each heating resistor 18 does not fluctuate, so that the ejection amount of ink droplets ejected from each nozzle 20 can be stabilized, resulting in forming excellent images by recording with improved gradation.

Since the drive frequency of the continuous pulse signals can be arbitrarily set, there is no effect of fluctuation between products in the manufacturing process of the print head or temperature changes in use, so that the ejection amount of ink droplets ejected from each nozzle 20 can be stabilized, resulting in forming excellent images by recording with improved gradation.

In the above, an example applied to the inkjet printer has been described; however, the present invention is not limited to this, and any apparatus may be incorporated as long as it ejects liquid in a liquid flow-path from a liquid-ejecting hole as liquid droplets. For example, an image-forming apparatus such an inkjet-type facsimile or copying machine can be incorporated. Also, an apparatus for ejecting a solution containing DNA (deoxyribonucleic acid) for detecting a biological material may be applied.

The print head has been described as a line type; however, the liquid ejected from a nozzle is not limited to ink, and any liquid may be enough as long as the liquid in a liquid chamber is ejected as liquid droplets.

Furthermore, the spring member 23 has been described as negative-pressure generating means for applying the negative pressure to ink in the ink chamber 21; however, the present invention is not limited to this, and any device may be incorporated as long as it prevents liquid in a liquid chamber from spontaneously leaking from a nozzle. For example, it may also be an arrangement of the bag member 24 for containing ink and the ink-feed opening 16. The heating resistor 18 has been described as ejecting-energy generating means for ejecting ink droplets from an ejecting unit; however, the present invention is not limited to this, and the ejecting-energy generating means may be any device in that liquid in a liquid flow-path is ejected by making the liquid into micro droplets by an electromechanical conversion device, for example.

Next, an embodiment according to the present invention for achieving a second object of the present invention will be described. The object of this embodiment is that when one dot is formed with a plurality of liquid droplets by using a head capable of deflecting the ejecting direction of the liquid droplet, the dot quality is improved by reducing the landing positional displacement between plural liquid droplets for forming the one dot, resulting in improving image quality.

According to the embodiment described above, the heating resistor 18 has been described as that one heating resistor 18 is arranged for each ink chamber 21. Whereas, according to this embodiment, a plurality of energy-generating elements are arranged for each ink chamber, as will be described later. In this embodiment, although not described, the above-described embodiment can of course be applied to this embodiment. The description of structures common to the above-described embodiment is omitted.

(Head Structure)

Figure 12:
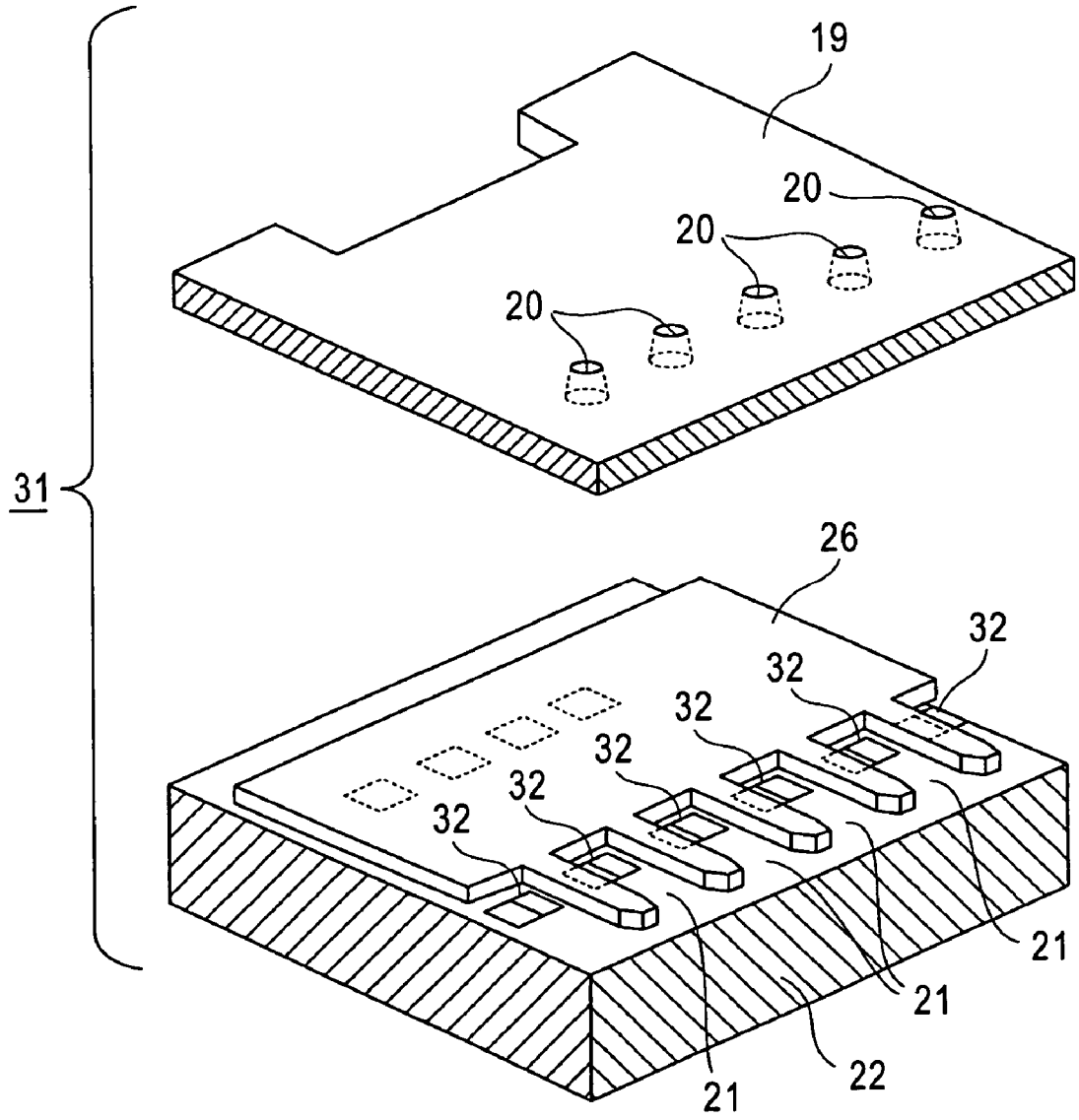
FIG. 12 is an exploded perspective view of a head of an inkjet printer applied to a liquid-ejecting apparatus according to another embodiment.

FIG. 12 is an exploded perspective view of a print head 31 of an inkjet printer (simply referred to as a printer below), which is exemplified as a liquid-ejecting apparatus according to the present invention. In FIG. 12, the nozzle member 19 is bonded on the barrier layer 26 in the same way as in the above-described embodiment.

Figure 13:
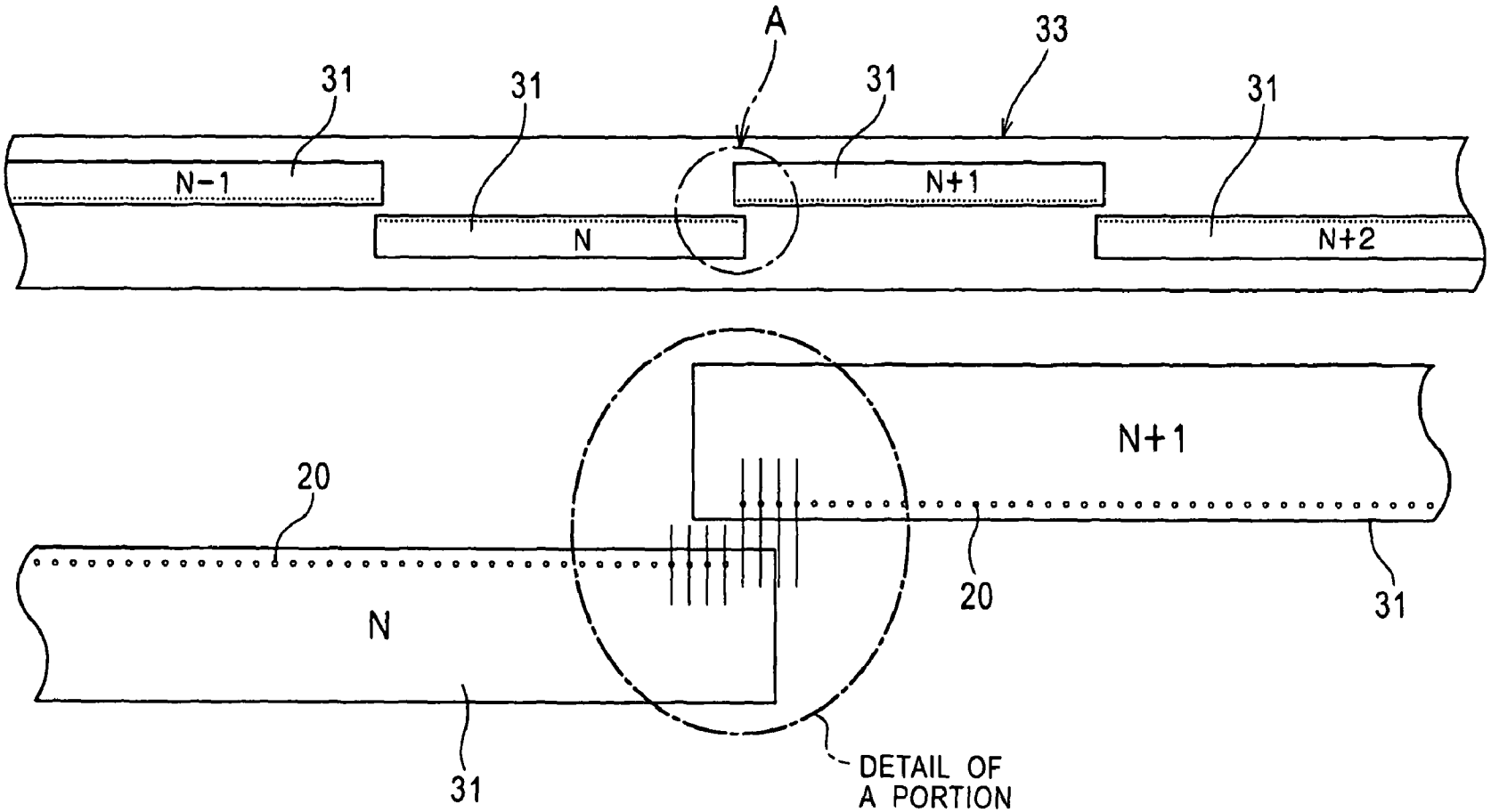
FIG. 13 is a plan view of a line head according to the embodiment.

According to this embodiment, a line head is also formed by arranging a plurality of the print heads 31 in the width direction of a photographic sheet. FIG. 13 is a plan view of a line head 33 according to the embodiment. FIG. 13 shows four print heads 31 ("N−1", "N", "N+1", and "N+2"). When the line head 33 is formed, a plurality of head chips, each chip being equivalent to the print head 31 except the nozzle member 19 shown in FIG. 12, are arranged. Then, over these head chips, a sheet of the nozzle member 19, on which the nozzles 20 are formed at positions corresponding to ink-ejecting units of the entire head chips, is bonded so as to form the line head 33. This is the same way as the above-described embodiment.

Since the ink-ejecting unit according to this embodiment is different from the above-described embodiment, this point will be described more in detail.

Figure 14A:
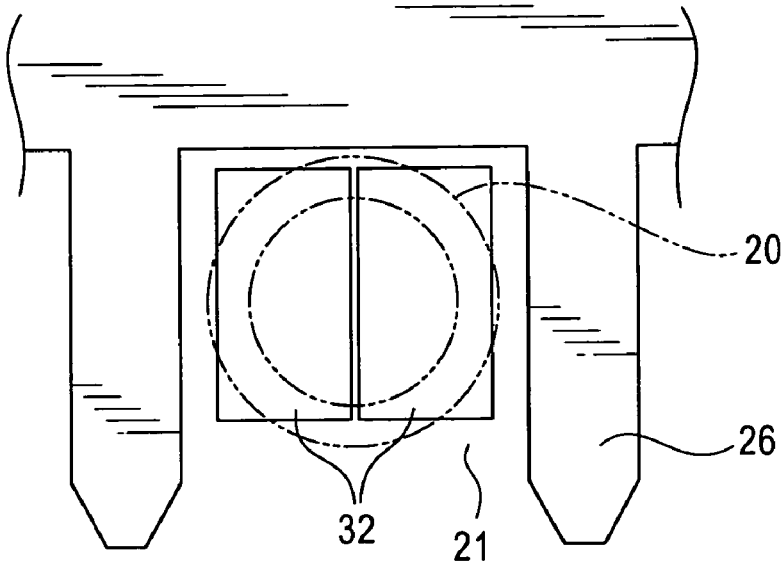
FIGS. 14A and 14B are a plan view and a side sectional view showing an ink-ejecting unit of the head in more detail, respectively.
Figure 14B:
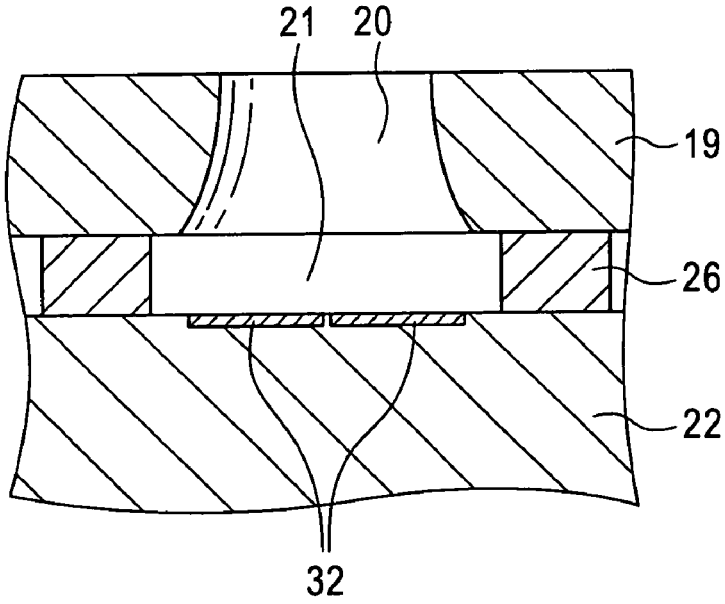

FIGS. 14A and 14B are a plan view and a side sectional view of a detailed ink-ejecting unit of the print head 31, respectively; FIG. 14A shows the nozzle 20 with dash-dotted lines.

As shown in FIGS. 14A and 14B, according to the embodiment, within one ink chamber 21, a heating resistor 32 divided into two is arranged. The arranging direction of the two divided heating resistors 32 is that of the nozzles 20 (ink-ejecting units) (the right and left direction in FIG. 14).

In the two-divided type made by longitudinally dividing one heating resistor 32 into two in such a manner, since the length is the same and the width is halved, the resistance of the heating resistor 32 is doubled. If the two-divided type-heating resistors 32 are connected in series, the resistance is quadrupled because the heating resistors 32 with doubled resistance are connected in series.

In order to boil ink contained within the ink chamber 21, it is necessary to heat the heating resistor 32 by supplying predetermined electric power to the heating resistor 32. By the energy during the boiling, ink is ejected. If the resistance is small, the current for passing through the heating resistor 32 is needed to increase; by increasing the resistance of the heating resistor 32, ink can be boiled with small current.

Thereby, the size of a transistor for passing the current therethrough can also be reduced, resulting in space-saving. In addition, although the resistance can be increased if the thickness of the heating resistor 32 is reduced, in view of the material selected for the heating resistor 32 and the strength (durability), the reduction in thickness of the heating resistor 32 has a predetermined limit. Therefore, the resistance of the heating resistor 32 is increased by dividing it without reducing the thickness thereof.

In the case where a heating resistor 32 divided into two is arranged within one ink chamber 21, if the time to reach the temperature boiling ink (bubble generating time) of each heating resistor 32 is equalized, ink on the two heating resistors 32 is simultaneously boiled so that ink droplets are ejected in the axial direction of the nozzle 20. Whereas, if time difference of the bubble generating time is produced between the two-divided heating resistors 32, ink on the two heating resistors 32 is not simultaneously boiled. Thereby, the ejecting direction of ink droplets is out of alignment with the axial direction of the nozzle 20, so that the ink droplets are ejected with deflection. Therefore, the ink droplet is landed at a position displaced from the position, at which an ink droplet is landed without deflection.

Figure 15A:
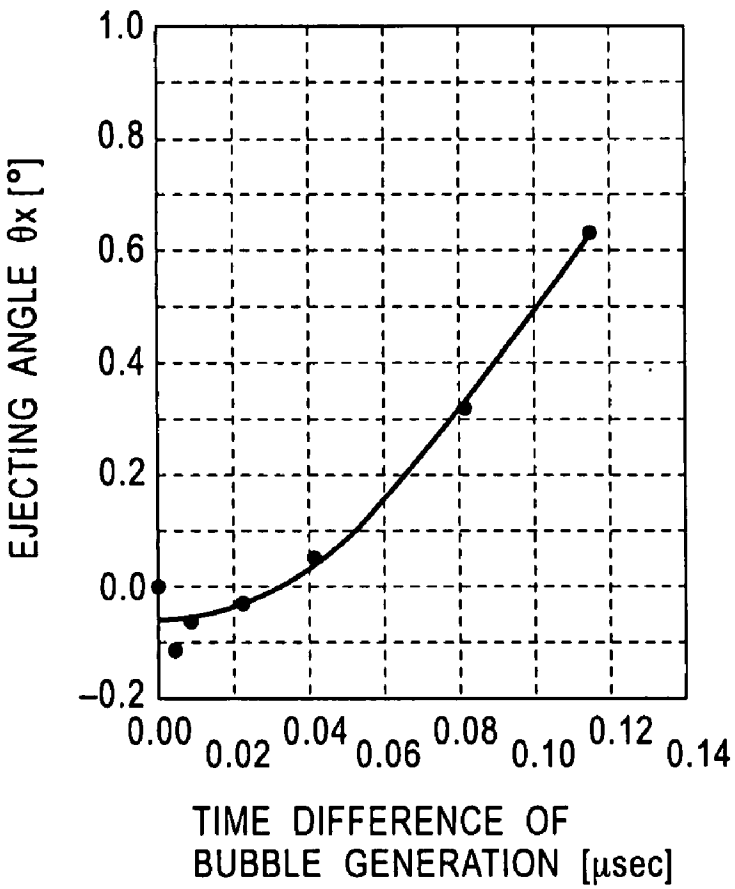
FIGS. 15A and 15B are graphs showing the relationship between the time difference of ink bubble generation of two-divided heating resistors and the ink ejecting angle.
Figure 15B:
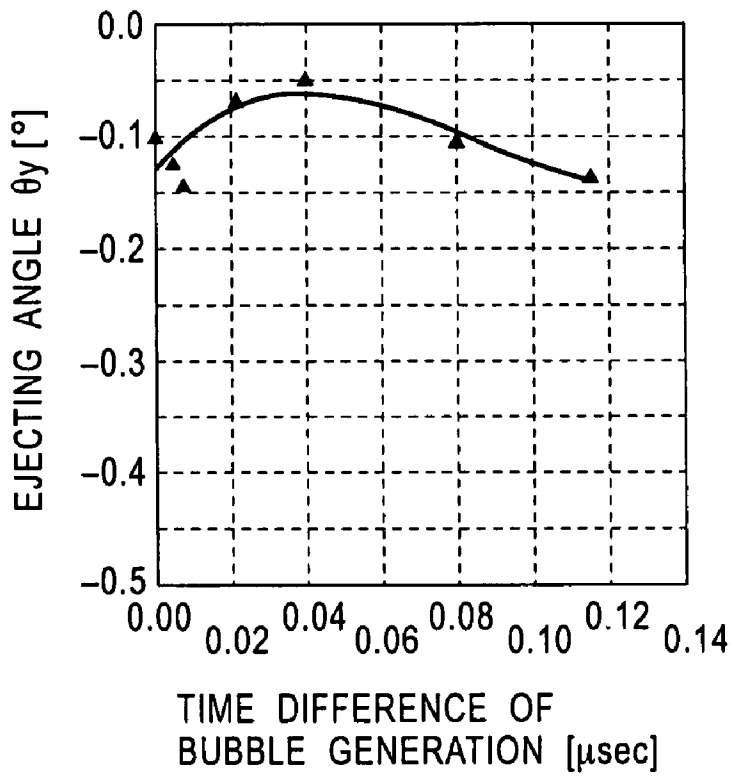
Figure 15C:
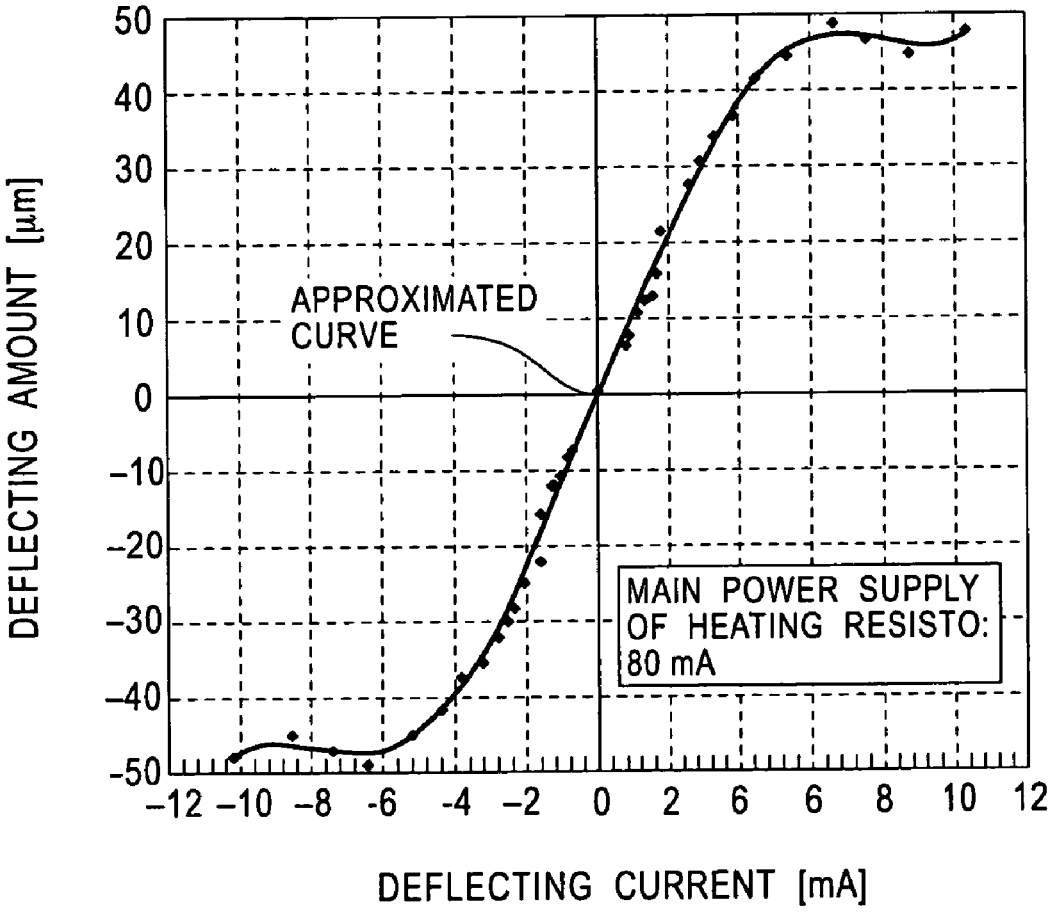
FIG. 15C shows measured data of the time difference of ink bubble generation in the two-divided heating resistors.

FIGS. 15A and 15B are graphs showing the relationship between the time difference of ink bubble generation of the two-divided heating resistors 32 and the ink ejecting angle, which are results from computer simulation. Referring to these graphs, the X direction (ordinate θx of the graph, note: not abscissa of the graph) indicates the arranging direction of the nozzles 20 while the Y direction (ordinate θy of the graph, note: not abscissa of the graph) indicates a direction perpendicular to the X direction (transferring direction of a photographic sheet). FIG. 15C shows measured data in that half of a current difference between the two-divided heating resistors 32 is plotted in abscissa as the time difference of ink bubble generation of the two-divided heating resistors 32 while the deflecting amount (measured by assuming the distance between the nozzle 20 and the landed position to be appropriately 2 mm) at the landing position of an ink droplet is plotted in ordinate as the ejecting angle of the ink droplet (X direction). In FIG. 15C, the deflection ejection of ink droplets is performed when the principal current of the heating resistor 32 is set to be 80 mA, and the deflecting current is superimposed on one heating resistor 32.

When the time difference of ink bubble generation is produced between the heating resistors 32 two-divided in the arranging direction of the nozzles 20, as shown in FIGS. 15A to 15C, the ejecting angle of an ink droplet is out of alignment with the vertical direction, and the ejecting angle θx of the ink droplet in the arranging direction of the nozzles 20 increases along with the time difference of ink bubble generation.

Then, according to the embodiment, by utilizing these characteristics, there are provided two-divided heating resistors 32, wherein the time difference of bubble generation is produced between the two heating resistors 32 by differentiating the electric current passing over one heating resistor 32 from that over the other heating resistor 32 so as to deflect the ejecting angle of ink droplets (ejecting-angle deflecting means).

If the resistances of the two-divided heating resistors 32 are not the same by errors in manufacturing, for example, since the time difference of bubble generation is produced between the two heating resistors 32, the ejecting angle of an ink droplet is out of alignment with the vertical direction, so that the landing position of the ink droplet is displaced from the original position. Whereas by changing electric current difference between the two-divided heating resistors 32, the bubble generating time of each heating resistor 32 is controlled and if the bubble generating time for the two-divided heating resistors 32 is equalized, the ejecting angle of an ink droplet can be aligned with the vertical direction.

For example, in the line head 33, by deflecting the ejecting angle of ink droplets ejected from a specific one or more of the entire print head 31 from the original ejecting angle, the ejecting angle is corrected in the print head 31 in which the ink droplet cannot be ejected in the direction perpendicular to the landing surface of a photographic sheet by errors in manufacturing, and the ink droplets can be ejected in the vertical direction.

Also, in one print head 31, only the ejecting angle of the ink droplet ejected from specific one or more ink-ejecting units may be deflected. If the ejecting angle of the ink droplet ejected from a specific ink-ejecting unit in one print head 31 is not in parallel with the ejecting angle of an ink drop from another ink-ejecting unit, for example, only the ejecting angle of the ink droplet from the specific ink-ejecting unit is deflected so as to align it in parallel with the ejecting angle of an ink droplet from another ink-ejecting unit.

Furthermore, in the case of the line head 33, if there is an ink-ejecting unit incapable of ejecting ink droplets or an ink-ejecting unit insufficiently capable of ejecting ink droplets, the ink droplets cannot be or hardly be ejected on the pixel row (in the direction perpendicular to the arranging direction of ink-ejecting units) corresponding to the ink-ejecting unit, so that dots are not formed, degrading image quality with a longitudinal white streak. Whereas according to the embodiment, by another ink-ejecting unit located in the vicinity, an ink droplet can be ejected instead of the ink-ejecting unit insufficiently capable of ejecting ink droplets.

Figure 16:
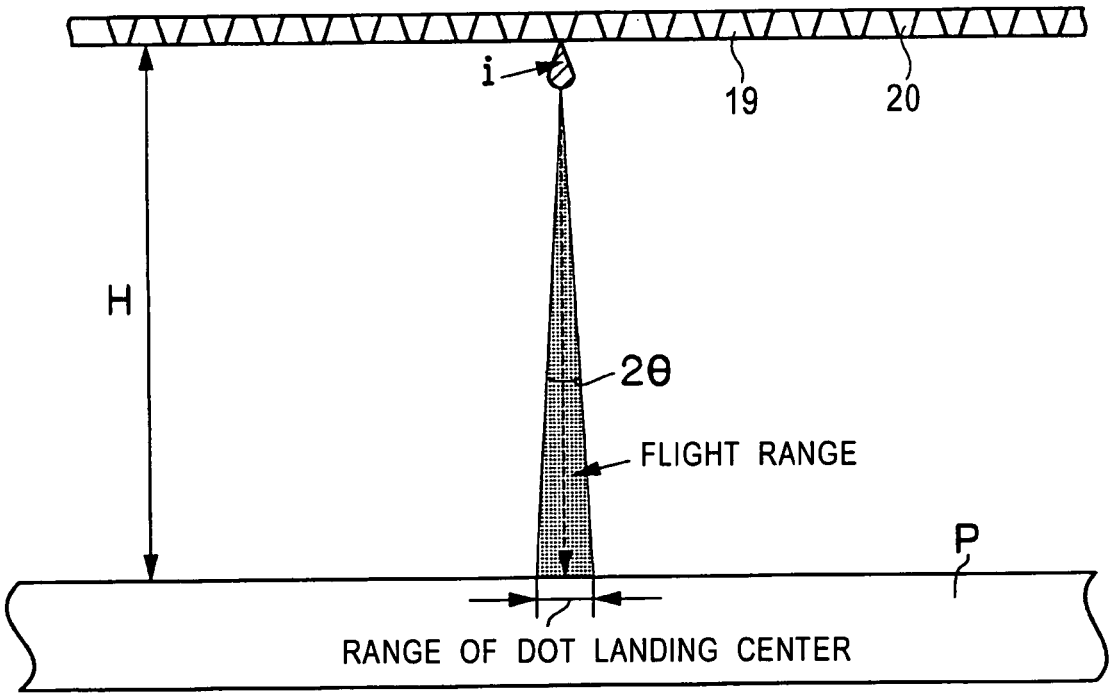
FIG. 16 is a sectional side view showing the relationship between the ink-ejecting unit and a photographic sheet.

Next, the degree of deflection of the ejecting angle of ink droplets will be described. FIG. 16 is a sectional side view showing the relationship between the ink-ejecting unit and the recording sheet P.

Referring to FIG. 16, the distance H between the edge of the ink-ejecting unit (the nozzle 20) and the recording sheet P is generally 1 to 2 mm appropriately; it is assumed to be H=2 mm (H is substantially constant) here. Also, when the resolution of the print head 31 is assumed to be 600 dpi, the space between adjacent ink-ejecting units (the nozzles 20) is 25.40×1000/600≈42.3 (μm).

The ejecting-direction deflecting means according to the embodiment is for deflecting the ejecting direction of an ink droplet ejected from one ink-ejecting unit so that the ink droplet is landed at a position or in the vicinity of the position where the ink droplet from another ink-ejecting unit located in the vicinity of the one ink-ejecting unit is landed without deflection.

According to the embodiment, the ejecting direction of an ink droplet ejected from each ink-ejecting unit is deflected by the control signal with J (J is a positive integer) bit in different directions of $2^J$ while the space between two landing positions of ink droplets mostly separated from the directions of $2^J$ is set so as to be $(2^J-1)$ times the space between two adjacent ink-ejecting units (the nozzles 20). Then, when the ink droplet is ejected from the ink-ejecting unit, any one of the directions of $2^J$ is selected.

When a two bit signal (J=2) is used as a control signal for example, the number of control signals is four of (0, 0), (0, 1), (1, 0), and (1, 1), and the ejecting directions of ink droplets are four ($2^J$=4). The distance between two dots separated mostly during deflection is three times the space between two adjacent ink-ejecting units $(2^J-1)$=3. Then, every time the control signal changes as it is (0, 0), (0, 1), (1, 0), and (1, 1), the landing position of the ink droplet (dot) is moved by the space between adjacent ink-ejecting units. In the above example, if the distance between two dots separated mostly during deflection is assumed to be three times the space (42.3 μm) between two adjacent ink-ejecting units, i.e. 126.9 μm, the deflecting angle θ(deg) is:

$$\tan 2\theta = 126.9/2000 \approx 0.0635$$

then, θ≈1.8 (deg).

Next, the method for deflecting the ejecting direction of ink droplets will be described in more detail.

Figure 17:
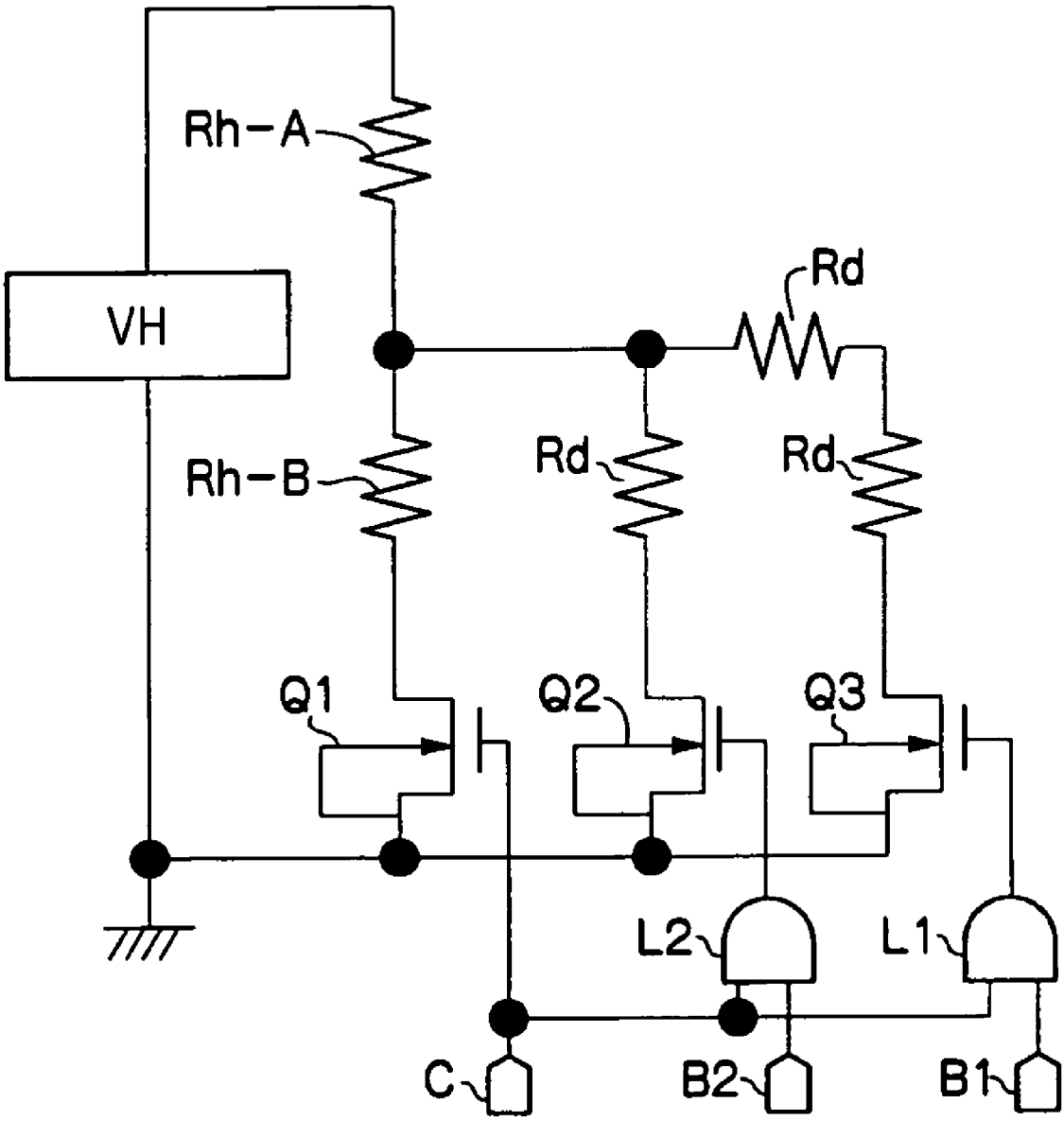
FIG. 17 is a conceptual diagram showing a structure in which time difference of the bubble generating can be set between the two-divided heating resistors.

FIG. 17 is a conceptual diagram showing a structure in which the time difference of the bubble generating time can be set between the two-divided heating resistors 32. In this example, using a 2-bit control signal (J=2), the ejecting direction of ink droplets is set in four steps by four types of electric current differences passing through a resistor Rh-A and a resistor Rh-B.

Referring to FIG. 17, the resistor Rh-A and the resistor Rh-B are resistances of the two-divided heating resistors 32, respectively; according to the embodiment, the resistor Rh-A is set smaller than the resistor Rh-B. From a connection path (an intermediate point) between the resistor Rh-A and the resistor Rh-B, a current can be taken out. Moreover, three resistors Rd are for deflecting the ejecting direction of an ink droplet. Furthermore, transistors Q1, Q2, and Q3 functions as switches for the resistor Rh-A and the resistor Rh-B.

An input unit C is for entering a binary control signal ("1" only when passing a current). Furthermore, symbols L1 and L2 denote binary entry AND gates, and symbols B1 and B2 denote input units for entering a binary signal ("0" or "1") of the AND gates L1 and L2, respectively. In addition, to the AND gates L1 and L2, electric power is supplied from a power supply VH. In this case, when C=1 as well as (B1, B2)=(0, 0) are entered, only the transistor Q1 is operated while the transistors Q2 and Q3 are not operated (current is not passed through the three resistors Rd). In this case, if a current is passed through the resistors Rh-A and Rh-B, the currents respectively passing through the resistor Rh-A and the resistor Rh-B are the same. Accordingly, the heating value of the resistor Rh-A is smaller than that of the resistor Rh-B, because the resistance of the resistor Rh-A is smaller than that of the resistor Rh-B. In this state, it is established that an ink droplet is landed on the extreme left. The landing position of the ink droplet at this time is set to be the position (including the vicinity thereof) at which the ink droplet from the ink-ejecting unit located in the second row of the units ahead on the left is landed without deflection.

When C=1 as well as (B1, B2)=(1, 0) are entered, the current is also passed through the two resistors Rd that are connected to the transistor Q3 in series (the current does not flow through the resistor Rd connected to the transistor Q2). As a result, the current flowing through the resistor Rh-B is reduced smaller than that when (B1, B2)=(0, 0) is entered. However, also in this case, it is established that the heating value of the resistor Rh-A is smaller than that of the resistor Rh-B.

The landing position of the ink droplet at this time is set to be the position at which the ink droplet from the ink-ejecting unit located adjacent on the left is landed without deflection.

Next, when C=1 as well as (B1, B2)=(0, 1) are entered, the current is passed through the resistor Rd that is connected to the transistor Q2 (the current does not flow through the two resistors Rd connected to the transistor Q3 in series). As a result, the current flowing through the resistor Rh-B is reduced further smaller than that when (B1, B2)=(1, 0) is entered. In this case, it is established that the heating value of the resistor Rh-A is the same as that of the resistor Rh-B. Thereby, the ink droplet at this case is ejected without deflection.

Furthermore, when C=1 as well as (B1, B2)=(1, 1) are entered, the current is passed through the three resistors Rd that are connected to the transistors Q2 and Q3. As a result, the current flowing through the resistor Rh-B is reduced further smaller than that when (B1, B2)=(0, 1) is entered. In this case, it is established that the heating value of the resistor Rh-A is larger than that of the resistor Rh-B.

The landing position of the ink droplet at this time is set to be the position at which the ink droplet from the ink-ejecting unit located adjacent on the right is landed without deflection.

As described above, resistance values of the resistors Rh-A, Rh-B, and Rd may be set so that every time the input value (B1, B2) changes as it is (0, 0), (1, 0), (0, 1), and (1, 1), the landing position of the ink droplet (dot) is moved by the space between adjacent ink-ejecting units.

Thereby, the landing position of an ink droplet can be switched to the following four positions: in addition to the position at which an ink droplet is landed without deflection (vertically to a landing surface of a photographic sheet); the position at which the ink droplet from the ink-ejecting unit located in the second row of the units ahead on the left is landed without deflection; the position at which the ink droplet from the ink-ejecting unit located adjacent on the left is landed without deflection; and the position at which the ink droplet from the ink-ejecting unit located adjacent on the right is landed without deflection. According to the input value (B1, B2), the ink droplet can be landed at any one of these four positions.

(Ejection-Controlling Means)

According to the embodiment, there is provided ejection-controlling means. When using the ejecting direction-deflecting means described above, one dot is formed by landing a plurality of liquid droplets so that at least part of landing regions are overlapped with each other (dot number modulation), the ejection-controlling means controls the ejection so that one of two dots neighboring in a direction perpendicular to the lining direction of the liquid-ejecting units is formed by a plurality of droplets ejected from one liquid-ejecting unit while the other dot is formed by a plurality of droplets ejected from another liquid-ejecting unit different from the one liquid-ejecting unit.

Then, a pixel position during image forming and the ink droplet-ejection executing timing will be described with reference to FIG. 18.

Figure 18:
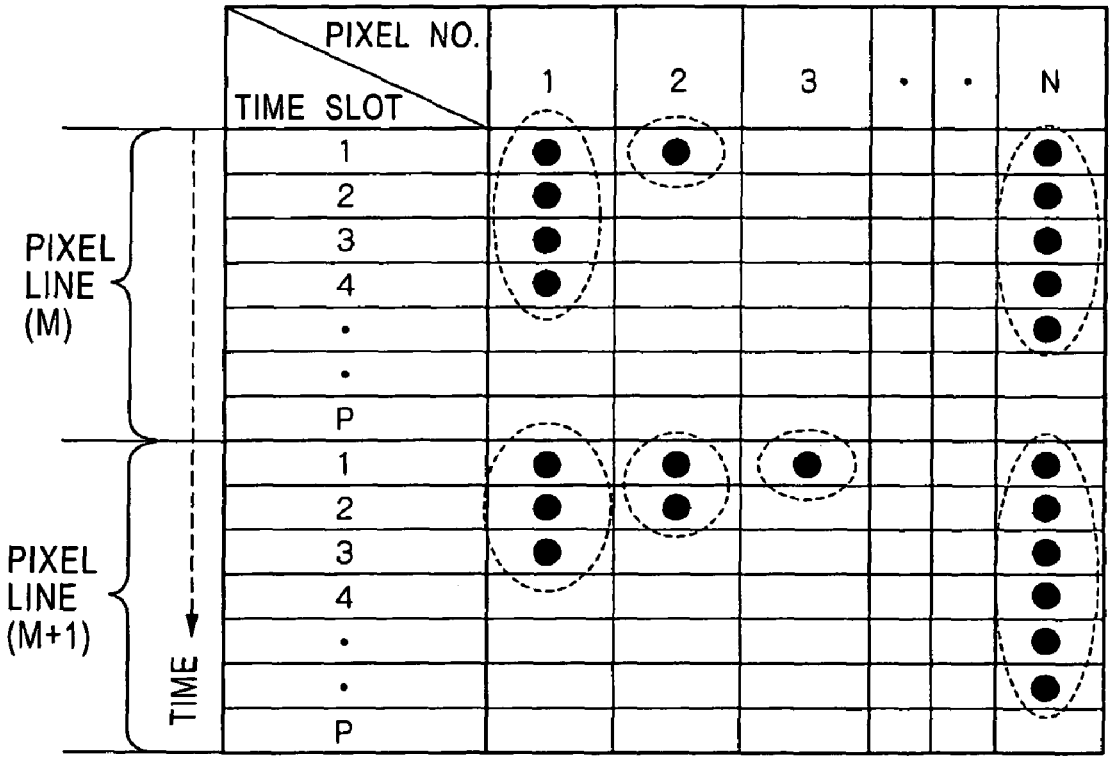
FIG. 18 is an explanatory view for illustrating the pixel position and the ink droplet-ejection executing timing in forming images.

Referring to FIG. 18, the ordinate represents an arbitrary time axis and the abscissa represents an arbitrary distance. The arbitrary time axis corresponds to the ejection executing timing of an ink droplet ejected according to the number of gradations, and the arbitrary distance corresponds to the pixel position according to the arranging direction of the ink-ejecting units. That is, FIG. 18 shows the number of ejections of ink droplets required for forming dots at each pixel position (i.e., the time required for forming dots in each pixel).

Referring to FIG. 18, the line in the arranging direction of ink-ejecting units in each pixel is defined as the pixel line. In the pixel lines, an M-th line and an (M+1)-th line are shown on the ordinate. In each pixel, up to P ink-droplets can be ejected for example. Therefore, each pixel has the ink droplet-ejection executing timings 1 to P, which are shown in FIG. 8 as the time slot. That is, in each pixel, dots are formed with maximum P droplets of ink. In other words, the maximum number of gradations is P+1. On the other hand, on the abscissa, the pixel positions are shown as the first to N-th of the pixel number. Therefore, the number of the ink-ejecting units in the arranging direction is N.

Referring to FIG. 18, on the M-th line and at the pixel position 1, the ink-droplet is ejected four times so as to form dots composed of four droplets of ink at the pixel position 1. Also, on the (M+1)-th line and at the pixel position 1, the ink-droplet is ejected three times so as to form dots composed of three droplets of ink at the pixel position 1.

The pixel position 1 of the M-th line and the pixel position 1 of the (M+1)-th line are arranged substantially on the same line. The other pixel positions are the same.

When dots formed with one or more ink droplets on the M-th line and dots formed with one or more ink droplets on the (M+1)-th line are arranged substantially on the same line in such a manner, that is, when dots are neighboring in the direction perpendicular to the arranging direction of the ink-ejecting units, the ejection-controlling means according to the embodiment controls the ejection so that the ink-ejecting unit used for forming a dot at a specific pixel position of the M-th line is differentiated from the ink-ejecting unit used for forming a dot at the specific pixel position of the (M+1)-th line.

(Liquid-Ejecting Unit Selecting Means)

The ejection-controlling means according to the embodiment includes ink-ejecting unit selecting means (equivalent to liquid-ejecting unit selecting means according to the present invention) for selecting an ink-ejecting unit from a plurality of ink-ejecting units for ejecting ink droplets.

In selecting an ink-ejecting unit by the ink-ejecting unit selecting means, there may be a method according to a predetermined pattern or a method of selecting at random.

The ink-ejecting units of one print head 31 are numbered as 1, 2, . . . N−1, and N while the pixel positions at which the ink droplets ejected from the ink-ejecting units 1, 2, . . . N−1, and N are landed are numbered as 1, 2, . . . N−1, and N, respectively.

At this time, in the method according to a predetermined pattern, when an ink droplet is ejected at the pixel position of the same number as that of the M-th line and the (M+1)-th line, it may be set that a different ink-ejecting unit is selected.

For example, for landing an ink droplet at the pixel position x (x is any one of 1 to N) of the M-th line, the ink-ejecting unit x may be used, and for landing an ink droplet at the pixel position x of the (M+1)-th line, the ink-ejecting unit (x+1) may be used.

Also, for landing an ink droplet at the pixel position x, an ink-ejecting unit disposed adjacent the ink-ejecting unit x, i.e., the ink-ejecting unit (x+1) or the ink-ejecting unit (x−1), may be used. Other than these ink-ejecting units, the ink-ejecting unit (x+2), the ink-ejecting unit (x−2), the ink-ejecting unit (x+3), or the ink-ejecting unit (x−3) may also be used.

Furthermore, for landing an ink droplet at the pixel position x of each line: at the pixel position x of the M-th line, the ink-ejecting unit x is used; at the pixel position x of the next (M+1)-th line, the ink-ejecting unit (x+1) is used; and at the pixel position x of the further next (M+2)-th line, the ink-ejecting unit x is used, such that the ink-ejecting unit x and the ink-ejecting unit (x+1) may be alternately used at the pixel position x of each line.

Alternatively, at the pixel position x of the M-th line, the ink-ejecting unit x is used; at the pixel position x of the next (M+1)-th line, the ink-ejecting unit (x+1) is used; at the pixel position x of the further next (M+2)-th line, the ink-ejecting unit (x−1) is used; and at the pixel position x of the further next (M+3)-th line, the ink-ejecting unit x is used, such that at the pixel position x of each line, the three continuously arranged ink-ejecting units of the ink-ejecting unit x, the ink-ejecting unit (x+1), and the ink-ejecting unit (x−1), in other words, in addition to the ink-ejecting unit x, which is located directly above the pixel position x, the ink-ejecting unit (x+1) and the ink-ejecting unit (x−1), which are located on neighboring both sides, may be repeatedly used.

Furthermore, at the pixel position x of the M-th line, the ink-ejecting unit (x−1) is used; at the pixel position x of the next (M+1)-th line, the ink-ejecting unit (x+1) is used; and at the pixel position x of the further next (M+2)-th line, the ink-ejecting unit (x−1) is used, such that at the pixel position x of each line, the ink-ejecting unit x, which is located directly above the pixel position x, may not be used.

(Ejecting-Direction Determining Means)

The ejection controlling means according to the embodiment includes ejecting-direction determining means for determining an ejecting direction of ink droplets ejected from the ink-ejecting unit selected by the ink-ejecting unit selecting means.

The ejecting-direction determining means determines the ejecting direction of ink droplets from the selected ink-ejecting unit and the pixel position at which ink droplets are landed.

For example, for landing an ink droplet at the pixel position x, when the ink-ejecting unit x is selected, the ink droplet is controlled to land without deflection. When an ink droplet is to be landed at the pixel position x and the ink-ejecting unit (x−1) is selected, the ejecting direction is controlled so that the ink droplet is landed at the pixel position x or in the vicinity thereof by deflecting the ink droplet toward the ink-ejecting unit x. Similarly, for landing an ink droplet at the pixel position x, when the ink-ejecting unit (x+1) is selected, the ejecting direction is controlled so that the ink droplet is landed at the pixel position x or in the vicinity thereof by deflection the ink droplet toward the ink-ejection unit x.

If an ink droplet is ejected in such a manner, even the image is with plural gradations, one pixel is constantly formed by a plurality of ink droplets ejected from one ink-ejecting unit. Therefore, displacement in landing positions of ink droplets can be minimized, improving image quality.

Also, in the direction perpendicular to the arranging direction of the ink-ejecting units (on the same line), two adjacent pixels are constantly formed by ink-ejecting units different from each other.

Accordingly, fluctuations inherent to an ink-ejecting unit cannot be arranged on the same line, improving quality of the entire images. Thereby, if a specific ink-ejecting unit cannot eject ink droplets by clogging, etc., for example, if the same ink-ejecting unit were used, at pixel position of this line, dots could not be always formed, whereas in the method described above, such a situation can be avoided.

Also, the signal processing for ejection execution is not complicated according to the embodiment as is in the technique, which is shown in Description of the Related Art of this application, proposed in Japanese Patent Application 2002-161928, which is assigned to the same assignee as this application, so that the signal processing can be simplified.

Furthermore, if there is an ink-ejecting unit with the ejecting direction being out of alignment with other ink-ejecting units in advance, when pixels with plural gradations are arranged, even if the ejecting direction of this ink-ejecting unit is not deflected for correction, the displacement of dot landing positions can be allowed to be inconspicuous.

Figure 19C:
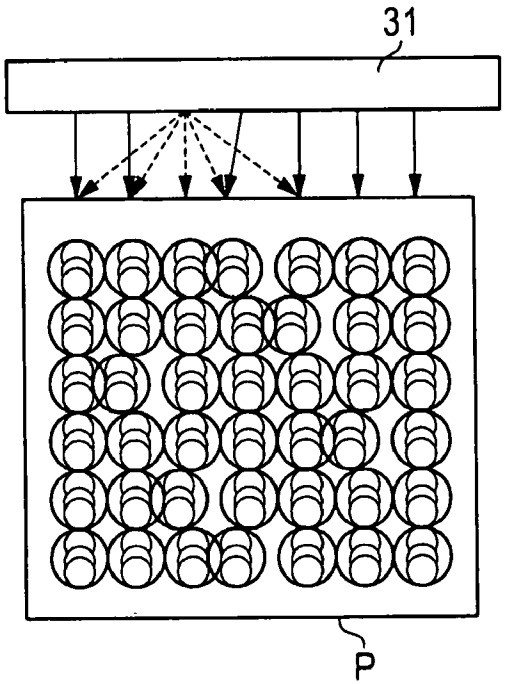
FIGS. 19A to 19C are drawings showing the pixel arrangement when one pixel is formed with three ink droplets.
Figure 19B:
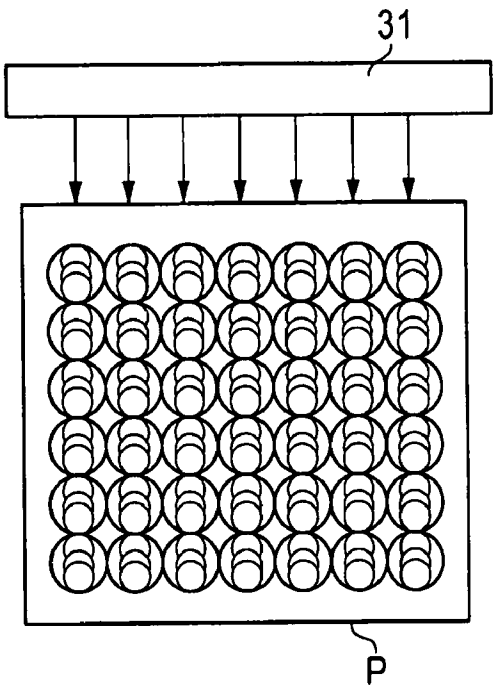
Figure 19A:
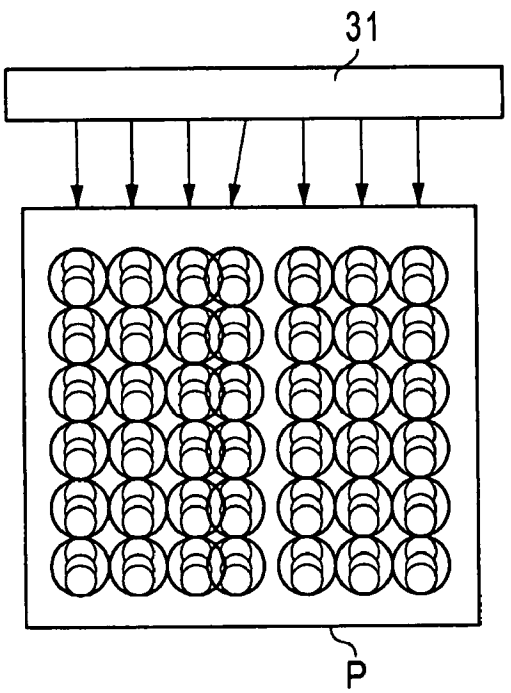
Figure 20:
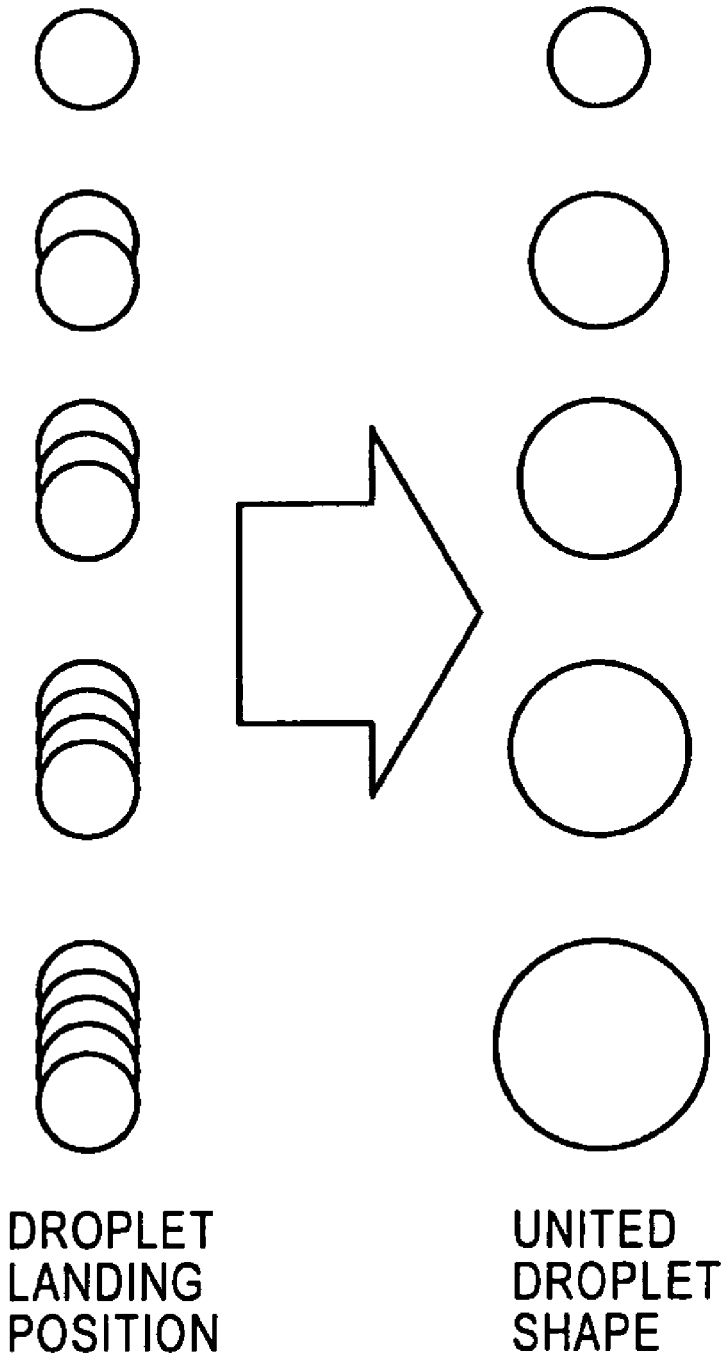
FIG. 20 is an explanatory view for illustrating the pulse number modulation.
Figure 21:
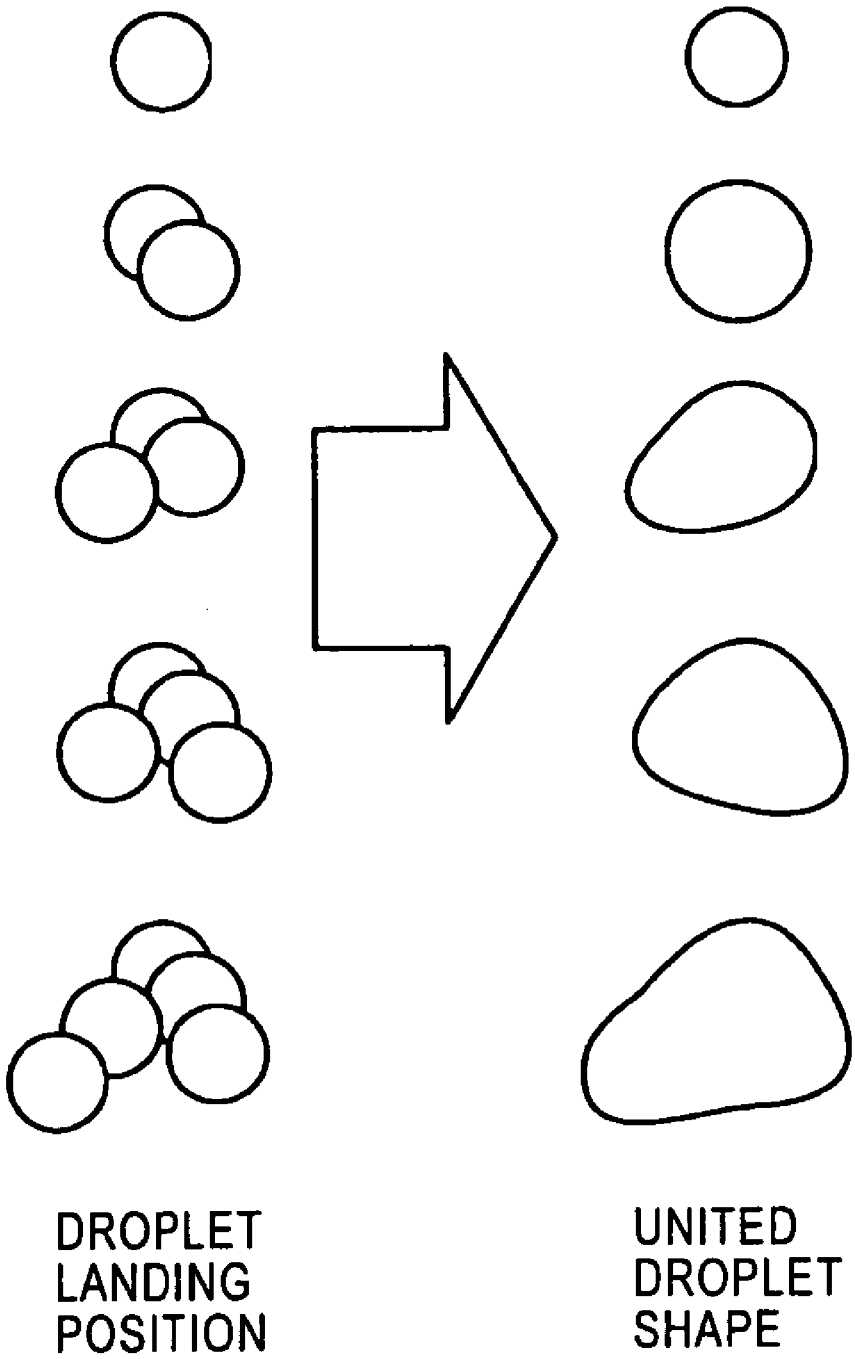
FIG. 21 is a drawing showing an example of large landing positional displacement of ink droplets when the pulse number modulation is performed.

FIGS. 19A to 19C are drawings showing the dot arrangement when one dot is formed by three ink droplets.

Both FIGS. 19A and 19B show the pixels arranged on the same line (arranged in the direction perpendicular to the arranging direction of the ink-ejecting units) formed by three ink droplets from the same ink-ejecting unit. For example, in the drawings, the entire pixel on the extreme left is formed by the ink-ejecting unit located on the extreme left. In other words, both FIGS. 19A and 19B show examples where the ejection controlling means according to the embodiment is not used.

FIG. 19A shows an example where the ejecting-direction deflecting means is not used, wherein the ejecting direction of the fourth ink-ejecting unit from the left is defected to the left in FIG. 8. In such a case, between the fourth dot and fifth dot from the left, a region without images exists as a white streak. Whereas in FIG. 19B, using the ejecting-direction deflecting means, the ejecting direction of an ink droplet from the fourth ink-ejecting unit from the left is deflected to the right in the drawing. By controlling the landing position of an ink droplet from the fourth ink-ejecting unit in such a manner, the white streak can be eliminated.

Whereas FIG. 19C shows an example where images are formed using the ejection controlling means without deflecting the ejecting direction of an ink droplet from the fourth ink-ejecting unit from the left as done in the example in FIG. 19B.

In the example of FIG. 19C, the fourth ink-ejecting unit from the left is used for forming the fourth dot from the left at the first line. In the next second line, the fourth ink-ejecting unit is used for forming the fifth dot from the left. Furthermore, in the third line, it is used forming the second dot from the left.

Then, in the pixels formed by the fourth ink-ejecting unit, although positional displacement is produced in comparison with other pixels, since the pixels formed by the fourth ink-ejecting unit cannot be continuously arranged in the direction perpendicular to the arranging direction of the ink-ejecting units, the white streak is not produced as is in the example in FIG. 19A.

The present invention is not limited to the embodiments described above, and various modifications may be made as follows, for example.

(1) According to the embodiments, two pixels adjacent in the direction perpendicular to the arranging direction of the ink-ejecting units are always formed by ejection of ink droplets from different ink-ejecting units; the invention is not limited to this, and in two neighboring pixels, one formed by the same ink-ejecting unit may exist. For example, at the pixel positions x on the M-th line and the (M+1)-th line, pixels may be formed by the ink-ejecting unit x while at the pixel positions x on the (M+2)-th line and the (M+3)-th line, pixels may be formed by the ink-ejecting unit (x+1).

Alternatively, at the pixel positions x on the M-th line to the (M+2)-th line, pixels may be formed by the ink-ejecting unit x while at the pixel positions x on the (M+3)-th line to the (M+5)-th line, pixels may be formed by the ink-ejecting unit (x+1).

(2) According to the embodiments, J=2 is exemplified as a J-bit control signal; alternatively, a control signal with J=3 or more may be used. By increasing the number of bits of the control signal so as to form a circuit, the deflection directions are further increased.

(3) According to the embodiments, the time difference of ink droplet boiling (bubble generation) is produced by differentiating the electric current passing through one of the two-divided heating resistors 32 from the other; the invention is not limited to this, and two-divided heating resistors 32 with the same resistance are arranged and timings passing through electric current may be differentiated. For example, there are independently provided switches for each of the two-divided heating resistors 32, and by turning on the switches with time difference, the time difference of bubble generation can be produced to ink on each of the heating resistors 32. Furthermore, the combination of differentiating current passing through each of the heating resistor 32 and differentiating timings for passing through current may also be made.

(4) According to the embodiments, the two divided heating resistors 32 are provided within one ink chamber 21; the invention is not limited to this, and within one ink chamber 21, three or more heating resistors 32 (energy-generating means) may be arranged. Also, a heating resistor is made of one not-divided body while on a substantial switch-back shape in plan view (substantial U-shape), a conductor (electrode) is connected to the folding back portion of the switch-back shape, so that a principal part of energy generating unit for ejecting ink droplets via the folding back portion of the switch-back shape is divided into at least two; energy generation of at least one of the principal part is differentiated from at least one of the other principal part, thereby controlling to deflect the ejecting direction of ink droplets.

(5) According to the embodiments, as thermal-type energy generating means, the heating resistor 32 is exemplified; alternatively, a heating element may be formed of a material other than a resistor. Also, any other energy generating means may be used not limited to the heating element. For example, there may be an electrostatic ejection system and a piezoelectric system.

The electrostatic ejection-type energy generating means is provided with a vibrating plate and two electrodes disposed under the vibrating plate with an airspace therebetween. A voltage is applied between the both electrodes so as to downward deflect the vibrating plate, and then, the voltage is adjusted to 0 V so as to free static electricity. At this time, by utilizing an elastic force produced when the vibrating plate is returned to the original state, ink droplets are ejected.

In this case, since energy generation difference between energy generating means is provided, when the vibrating plate is returned to the original state (static electricity is freed by adjusting the voltage to be 0 V), time difference may be provided between two energy generating means, or voltage values may be differentiated from each other and applied to two energy generating means.

Also the piezoelectric energy generating means is a layered product of a piezoelectric element having electrodes formed on both surfaces and a vibrating plate.

When a voltage is applied to the electrodes on both surfaces of the piezoelectric element, a bending moment is generated on the vibrating plate by the piezoelectric effect so as to deflect the vibrating plate. By utilizing this deflection, ink droplets are ejected.

In also this case, in the same way as above, since energy generation difference between energy generating means is provided, when a voltage is applied to the electrodes on both surfaces of the piezoelectric element, time difference may be provided between two energy generating means, or voltage values may be differentiated from each other and applied to two energy generating means.

(6) According to the embodiments, the print head 31 and the line head 33 used for the printer are exemplified; however, the invention is not limited to the printer and may be applied to various kinds of liquid-ejecting apparatus. For example, an apparatus for ejecting a solution containing DNA for detecting a biological material may be applied.

As described above, according to the embodiments, the displacement in landing positions of ink droplets can be minimized, improving image quality. Also, the signal processing for ejection execution is not complicated so that the signal processing can be simplified.

Furthermore, if there is an ink-ejecting unit with the ejecting direction being out of alignment with other ink-ejecting units in advance, when pixels with plural gradations are arranged, even if the ejecting direction of this ink-ejecting unit is not deflected for correction, the displacement of dot landing positions can be allowed to be inconspicuous.

What is claimed is:

1. A liquid-ejecting apparatus comprising:

a nozzle member having a nozzle for ejecting liquid therefrom;

a liquid chamber formed corresponding to the nozzle;

an element disposed within the liquid chamber for generating energy for ejecting liquid contained in the liquid chamber from the nozzle as a liquid-droplet group; and an electric circuit unit for generating a pulse signal for feeding said pulse signal to the element, wherein the ejection amount of each liquid droplet of the liquid-droplet group continuously ejected from the nozzle toward one landing point is fixed or approximated at a constant corresponding to a frequency band of the pulse signal of approximately 1 kHz to 10 kHz, and liquid is ejected by controlling a drive frequency of the pulse signal which can be set within the frequency band, wherein the element is for pushing and ejecting liquid from the nozzle by heating the liquid contained in the liquid chamber so as to generate bubbles.

2. An apparatus according to claim 1, wherein the liquid chamber is formed so as to have a height capable of replenishing the same amount of liquid as that ejected from the nozzle in said frequency band of the pulse signal.

3. An apparatus according to claim 1, further comprising a member for applying the same degree of negative pressure as under that the surface of liquid in the nozzle is not drawn back to the liquid chamber to liquid contained in the liquid chamber in said frequency band of the pulse signal.

* * * * *